US011194286B2

(12) United States Patent
Amann et al.

(10) Patent No.: US 11,194,286 B2
(45) Date of Patent: Dec. 7, 2021

(54) LATCHING ASSEMBLY FOR SECURING TONER CARTRIDGES IN AN IMAGE FORMING DEVICE

(71) Applicant: LEXMARK INTERNATIONAL, INC., Lexington, KY (US)

(72) Inventors: Mark William Amann, Lexington, KY (US); Brian Allen Blair, Richmond, KY (US); Brian Lester Boettcher, Versailles, KY (US); James Anthany Carter, II, Lexington, KY (US); Jie Chen, Lexington, KY (US); Benjamin Charles Devore, Lexington, KY (US); Darin Michael Gettelfinger, Nicholasville, KY (US); Michael James Shanor, Lexington, KY (US); Christopher Kent Washing, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 17/152,211

(22) Filed: Jan. 19, 2021

(65) Prior Publication Data

US 2021/0255580 A1 Aug. 19, 2021

Related U.S. Application Data

(60) Provisional application No. 62/976,379, filed on Feb. 14, 2020.

(51) Int. Cl.

| | |
|---|---|
| ***G03G 21/16*** | (2006.01) |
| ***G03G 15/08*** | (2006.01) |
| ***G03G 21/18*** | (2006.01) |

(52) U.S. Cl.
CPC ..... *G03G 21/1676* (2013.01); *G03G 15/0872* (2013.01); *G03G 21/1842* (2013.01); (Continued)

(58) Field of Classification Search
CPC ..... G03G 15/0872; G03G 21/1633; G03G 21/1647; G03G 21/1676; G03G 21/1842; (Continued)

(56) References Cited

U.S. PATENT DOCUMENTS 7,831,168 B2 11/2010 Allen et al.
8,200,126 B2 6/2012 Chaudhuri et al.
(Continued)

OTHER PUBLICATIONS

U.S. Appl. No. 17/152,244, filed Jan. 19, 2021 (Blair et al.).
U.S. Appl. No. 17/152,264, filed Jan. 19, 2021 (Amann et al.).
U.S. Appl. No. 17/152,285, filed Jan. 19, 2021 (Chen et al.).

*Primary Examiner* — Sophia S Chen

(57) ABSTRACT

A system for an electrophotographic image forming device includes a basket insertable into and extendable out of the image forming device. The basket includes a plurality of positioning slots each configured to receive a corresponding toner cartridge of a plurality of toner cartridges. The basket includes a cartridge latching assembly configured to apply a hold-down force on each toner cartridge to rigidly hold each toner cartridge against corresponding datums of the basket. A basket latching assembly in the image forming device is configured to apply a hold-down force on the basket when the basket is inserted into the image forming device to rigidly hold the basket against corresponding datums of the image forming device for positioning the plurality of toner cartridges in respective operational positions within the image forming device with only the cartridge latching assembly of the basket directly applying hold-down forces on the plurality of toner cartridges.

19 Claims, 27 Drawing Sheets

(52) U.S. Cl.
CPC ..... *G03G 2215/0872* (2013.01); *G03G 2221/163* (2013.01); *G03G 2221/1654* (2013.01); *G03G 2221/1869* (2013.01)

(58) Field of Classification Search
CPC ..... G03G 2215/0872; G03G 2221/163; G03G 2221/1654; G03G 2221/1869
See application file for complete search history.

(56) References Cited

U.S. PATENT DOCUMENTS

| | | | | |
|---|---|---|---|---|
| 9,152,083 | B2 | 10/2015 | Buchanan et al. | |
| 9,316,944 | B2 | 4/2016 | Martin et al. | |
| 9,519,262 | B1 | 12/2016 | Tonges et al. | |
| 9,910,403 | B2 | 3/2018 | Amann et al. | |
| 10,474,093 | B1 | 11/2019 | Amann et al. | |
| 10,488,813 | B2 * | 11/2019 | Wang ..... | G03G 21/1647 |
| 10,656,592 | B1 | 5/2020 | Amann et al. | |
| 2009/0003875 | A1 | 1/2009 | Toba et al. | |
| 2011/0052254 | A1 * | 3/2011 | Hashimoto ..... | G03G 21/1676 399/110 |
| 2013/0108316 | A1 * | 5/2013 | Sato ..... | G03G 21/1647 399/110 |
| 2015/0346682 | A1 * | 12/2015 | Matsumaru ..... | G03G 21/1842 399/110 |
| 2017/0102670 | A1 | 4/2017 | Tosh et al. | |
| 2020/0133188 | A1 | 4/2020 | Amann et al. | |
| 2020/0142348 | A1 | 5/2020 | Amann et al. | |
| 2021/0003964 | A1 * | 1/2021 | Sato ..... | G03G 21/1842 |

* cited by examiner

LATCHING ASSEMBLY FOR SECURING TONER CARTRIDGES IN AN IMAGE FORMING DEVICE

CROSS REFERENCES TO RELATED APPLICATIONS

This application claims priority to U.S. Provisional Patent Application Ser. No. 62/976,379, filed Feb. 14, 2020, entitled "Assembly for Supporting Multiple Toner Cartridges in an Image Forming Device," the content of which is hereby incorporated by reference in its entirety.

BACKGROUND

1. Field of the Disclosure

The present disclosure relates generally to image forming devices and more particularly to a latching assembly for securing toner cartridges in an image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable toner cartridges that have a shorter lifespan than the image forming device. It is important that the toner cartridge(s) are precisely aligned within the image forming device. If a toner cartridge is misaligned, one or more input gears on the toner cartridge may fail to maintain proper gear mesh with corresponding output gears in the image forming device and one or more electrical contacts on the toner cartridge may fail to maintain an electrical connection with corresponding electrical contacts in the image forming device. Further, if a toner cartridge is misaligned, various imaging components of the toner cartridge (such as a photoconductive drum) may be incorrectly positioned relative to the image forming device potentially resulting in toner leakage or print quality detects. The toner cartridge(s) must also be rigidly held in place after installation in the image forming device in order to prevent the positional alignment of the toner cartridge(s) from being disturbed during operation. The requirement for tight positional control must be balanced with the need to permit a user to easily load and unload the toner cartridge(s) into and out of the image forming device. Accordingly, it will be appreciated that precise alignment of the toner cartridge(s) and relatively simple installation of the toner cartridge(s) into and out of the image forming device is desired.

SUMMARY

A system for an electrophotographic image forming device according to one example embodiment includes a plurality of toner cartridges and a basket insertable into and extendable out of the image forming device. The basket includes a plurality of positioning slots each configured to receive a corresponding toner cartridge of the plurality of toner cartridges. The basket includes a cartridge latching assembly configured to apply a hold-down force on each of the plurality of toner cartridges to rigidly hold each of the plurality of toner cartridges against corresponding datums of the basket. A basket latching assembly in the image forming device is configured to apply a hold-down force on the basket when the basket is inserted into the image forming device to rigidly hold the basket against corresponding datums of the image forming device for positioning the plurality of toner cartridges in respective operational positions within the image forming device with only the cartridge latching assembly of the basket directly applying hold-down forces on the plurality of toner cartridges.

A system for an electrophotographic image forming device according to another example embodiment includes a basket insertable into and extendable out of the image forming device. The basket includes a plurality of positioning slots each configured to hold a corresponding toner cartridge of a plurality of toner cartridges. The basket includes a cartridge latching assembly configured to apply a hold-down force on each of the plurality of toner cartridges to hold each of the plurality of toner cartridges against corresponding datums of the basket. A guide rail assembly is positioned within the image forming device. The guide rail assembly is movable relative to the image forming device between a raised position and a lowered position and is positioned to raise and lower the basket when the guide rail assembly moves between the raised position and the lowered position with the basket inserted into the image forming device. The basket is slidable along the guide rail assembly into and out of the image forming device when the guide rail assembly is in the raised position. The basket is in an operational position within the image forming device when the guide rail assembly is in the lowered position. A basket latching assembly in the image forming device is configured to hold the basket in the operational position of the basket when the guide rail assembly is in the lowered position.

A system for an electrophotographic image forming device according to another example embodiment includes an access door movable between a closed position covering an opening of the image forming device and an open position exposing the opening of the image forming device. A basket is insertable into and extendable out of the opening when the access door is in the open position. The basket includes a plurality of positioning slots each configured to hold a corresponding toner cartridge of a plurality of toner cartridges. The basket includes a cartridge latching assembly configured to apply a hold-down force on each of the plurality of toner cartridges to hold each of the plurality of toner cartridges against corresponding datums of the basket. A basket latching assembly in the image forming device is movable between a latching position and an unlatching position. The basket latching assembly is operatively connected to the access door such that the basket latching assembly moves from the latching position to the unlatching position when the access door moves from the closed position to the open position and the basket latching assembly moves from the unlatching position to the latching position when the access door moves from the open position to the closed position. The basket latching assembly is configured to hold the basket against corresponding datums of the image forming device when the basket latching assembly is in the latching position. The basket latching assembly is configured to release the basket permitting the basket to extend out of the opening when the basket latching assembly is in the unlatching position.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely to typify possible variations. Portions and features of some embodiments may be included in or substituted for those of others. The following description, therefore, is not to be taken in a limiting sense and the scope of the present disclosure is defined only by the appended claims and their equivalents.

Figure 1:
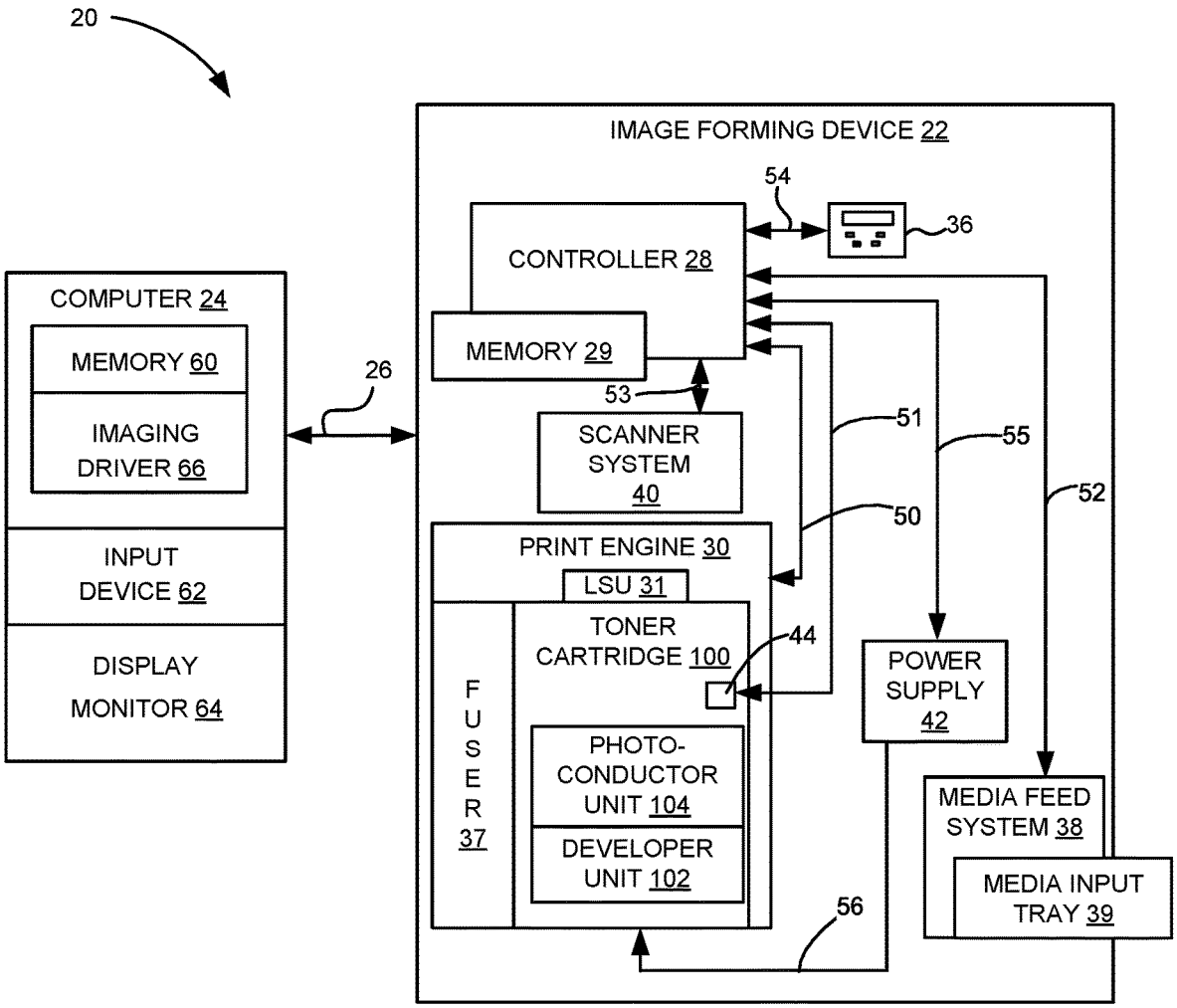
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, a toner cartridge 100, a user interface 36, a media feed system 38, a media input tray 39, a scanner system 40 and a power supply 42. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone el ectrophotographic printer.

Controller 28 includes a processor unit and associated electronic memory 29. The processor unit may include one or more integrated circuits in the form of a microprocessor or central processing unit and may include one or more Application-Specific integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with media feed system 38 via a communications link 52. Controller 28 communicates with scanner system 40 via a communications link 53. User interface 36 is communicatively coupled to controller 28 via a communications link 54. Controller 28 communicates with power supply 42 via a communications link 55. Controller 28 processes print and scan data and operates print engine 30 during printing and scanner system 40 during scanning. Processing circuitry 44 may provide authentication functions, safety and operational interlocks, operating parameters and usage information related to toner cartridge 100. Processing circuitry 44 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile or non-volatile memory or combination thereof or any memory device convenient for use with processing circuitry 44.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100 and a fuser 37, all mounted within image forming device 22. Toner cartridge 100 is removably mounted in image forming device 22. Power supply 42 provides an electrical voltage to various components of toner cartridge 100 via an electrical path 56. Toner cartridge 100 includes a developer unit 102 that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. In another embodiment, the toner development system utilizes what is commonly referred to as a dual component development system. In this embodiment, toner in the toner reservoir of developer unit 102 is mixed with magnetic carrier beads. The magnetic carrier beads may be coated with a polymeric film to provide triboelectric properties to attract toner to the carrier beads as the toner and the magnetic carrier beads are mixed in the toner reservoir. In this embodiment, developer unit 102 includes a developer roll that attracts the magnetic carrier beads having toner thereon to the developer roll through the use of magnetic fields. Toner cartridge 100 also includes a photoconductor unit 104 that houses a charge roll, a photoconductive drum and a waste toner removal system. Although the example image forming device 22 illustrated in FIG. 1 includes one toner cartridge, in the case of an image forming device configured to print in color, separate toner cartridges may be used for each toner color. For example, in one embodiment, the image forming device includes four toner cartridges, each toner cartridge containing a particular toner color (e.g., black, cyan, yellow and magenta) to permit color printing.

Figure 2:
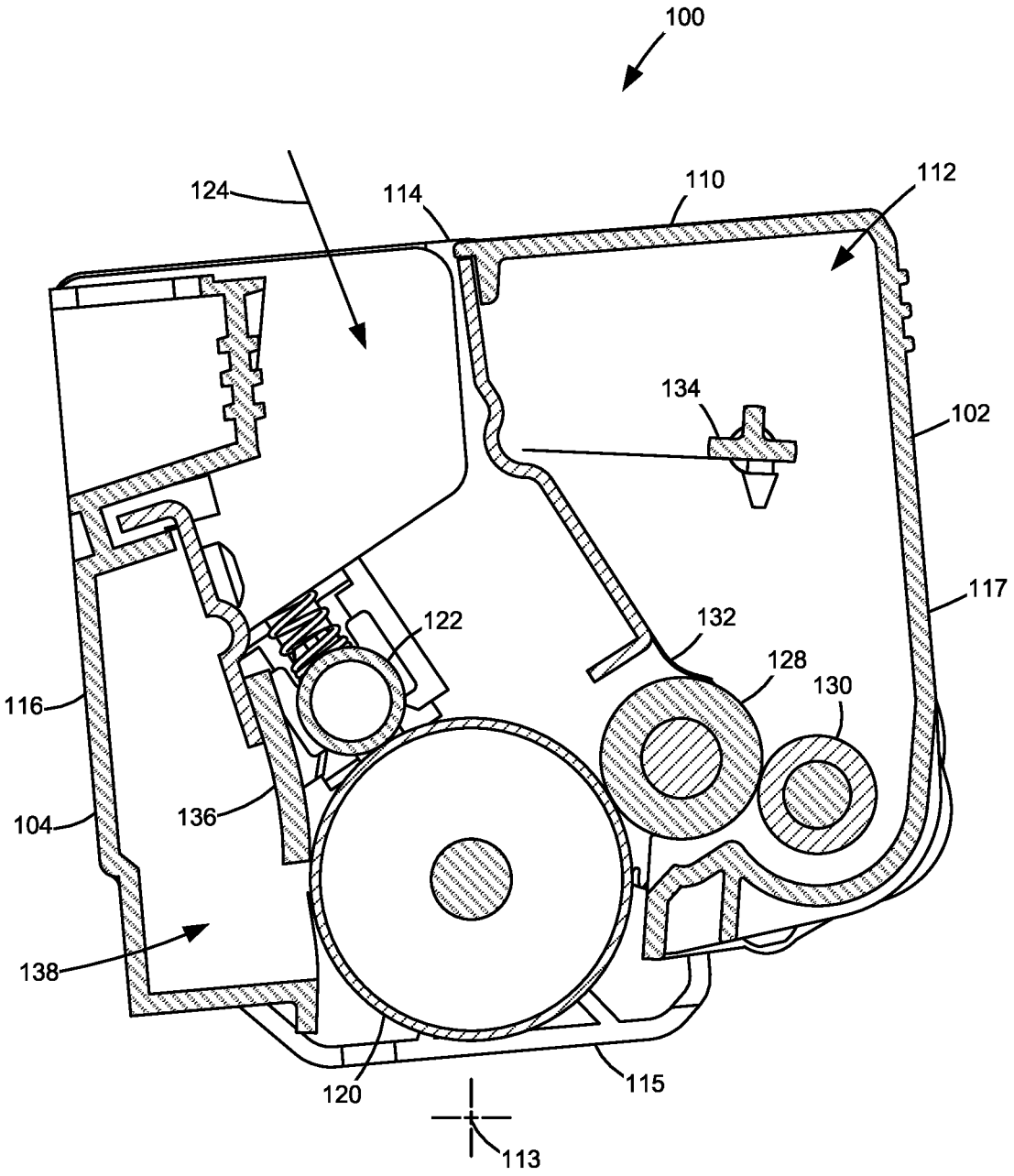
FIG. 2 is a cross-sectional view of a toner cartridge of the imaging system according to one example embodiment.

FIG. 2 shows toner cartridge 100 according to one example embodiment. Toner cartridge 100 includes an elongated housing 110 that includes walls forming a toner reservoir 112. In the example embodiment illustrated, housing 110 extends along a longitudinal dimension 113 and includes a top 114, a bottom 115, a first side 116 and a second side 117 that extend between longitudinal ends 118, 119 (FIGS. 4 and 5) of housing 110. In this embodiment, developer unit 102 is positioned along side 117 of housing 110 and photoconductor unit 104 is positioned along side 116 of housing 110.

The electrophotographic printing process is well known in the art and, therefore, is described briefly herein. During a print operation, a rotatable charge roll 122 of photoconductor unit 104 charges the surface of a rotatable photoconductive drum 120. The charged surface of photoconductive drum 120 is then selectively exposed to a laser light source 124 from LSU 31 through a slit 126 (FIGS. 4 and 5) in the top 114 of housing 110 to form an electrostatic latent image on photoconductive drum 120 corresponding to the image to be printed. Charged toner from developer unit 102 is picked up by the latent image on photoconductive drum 120 creating a toned image on the surface of photoconductive drum 120. Charge roll 122 and photoconductive drum 120 are each electrically charged to a respective predetermined voltage by power supply 42 in order to achieve a desired voltage differential between the charged portions of the surface of photoconductive drum 120 and the portions of the surface of photoconductive drum 120 discharged by laser light source 124.

Developer unit 102 includes toner reservoir 112 having toner stored therein and a rotatable developer roll 128 that supplies toner from toner reservoir 112 to photoconductive drum 120. In the example embodiment illustrated, a rotatable toner adder roll 130 in developer unit 102 supplies toner from toner reservoir 112 to developer roll 128. A doctor blade 132 disposed along developer roll 128 provides a substantially uniform layer of toner on developer roll 128 for transfer to photoconductive drum 120. As developer roll 128 and photoconductive drum 120 rotate, toner particles are electrostatically transferred from developer roll 128 to the latent image on photoconductive drum 120 forming a toned image on the surface of photoconductive drum 120. In one embodiment, developer roll 128 and photoconductive drum 120 rotate in opposite rotational directions such that their adjacent surfaces move in the same direction to facilitate the transfer of toner from developer roll 128 to photoconductive drum 120. One or more movable toner agitators 134 may be provided in toner reservoir 112 to distribute the toner therein and to break up any clumped toner. Developer roll 128 and toner adder roll 130 are each electrically charged to a respective predetermined voltage by power supply 42 in order to attract toner from reservoir 112 to toner adder roll 130 and to electrostatically transfer toner from toner adder roll 130 to developer roll 128 and from developer roll 128 to the latent image on the surface of photoconductive drum 120. Doctor blade 132 may also be electrically charged to a predetermined voltage by power supply 42 as desired.

Figure 3:
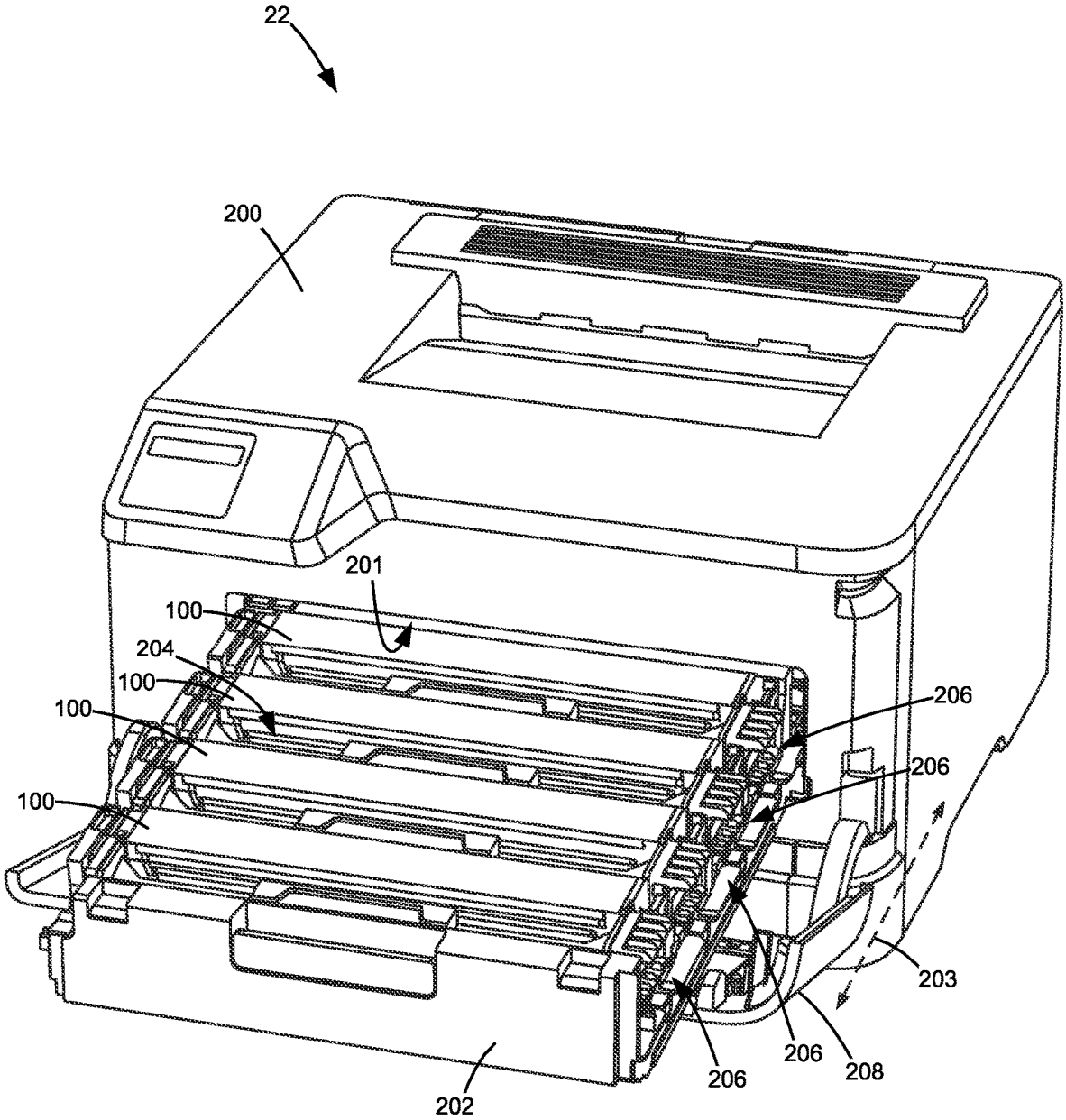
FIG. 3 is a perspective view of an image forming device showing a drawer having a basket holding four toner cartridges according to one example embodiment.

The toned image is then transferred from photoconductive drum 120 to the print media (e.g., paper) either directly by photoconductive drum 120 or indirectly by an intermediate transfer member. In the example embodiment illustrated, the surface of photoconductive drum 120 is exposed along the bottom 115 of housing 110 where the toned image transfers from photoconductive drum 120 to the print media or intermediate transfer member. Fuser 37 (FIG. 1) then fuses the toner to the print media. A cleaner blade 136 (or cleaner roll) of photoconductor unit 104 removes any residual toner adhering to photoconductive drum 120 after the toner is transferred from photoconductive drum 120 to the print media or intermediate transfer member. Waste toner from cleaner blade 136 may be held in a waste toner reservoir 138 in photoconductor unit 104 as illustrated or moved to a separate waste toner container. The cleaned surface of photoconductive drum 120 is then ready to be charged again and exposed to laser light source 124 to continue the printing cycle, FIG. 3 shows image forming device 22 according to one example embodiment. Image forming device 22 includes a housing 200 and a drawer 202 mounted on housing 200. In the example embodiment illustrated, drawer 202 is slidable into and out of an opening 201 of housing 200 along a sliding direction 203. In the embodiment illustrated, drawer 202 is accessible through an access door 208 that is movable between a closed position and an open position relative to opening 201. Drawer 202 includes a basket 204 configured to receive and support four toner cartridges 100 in image forming device 22. In this embodiment, each of the four toner cartridges 100 is substantially the same except for the color of the toner contained therein. Toner cartridges 100 are vertically insertable into and removable from four corresponding positioning slots 206 of basket 204. Positioning slots 206 of basket 204 locate toner cartridges 100 in their operating positions within image forming device 22 when toner cartridges 100 are installed in basket 204 and drawer 202 is closed.

Figure 4:
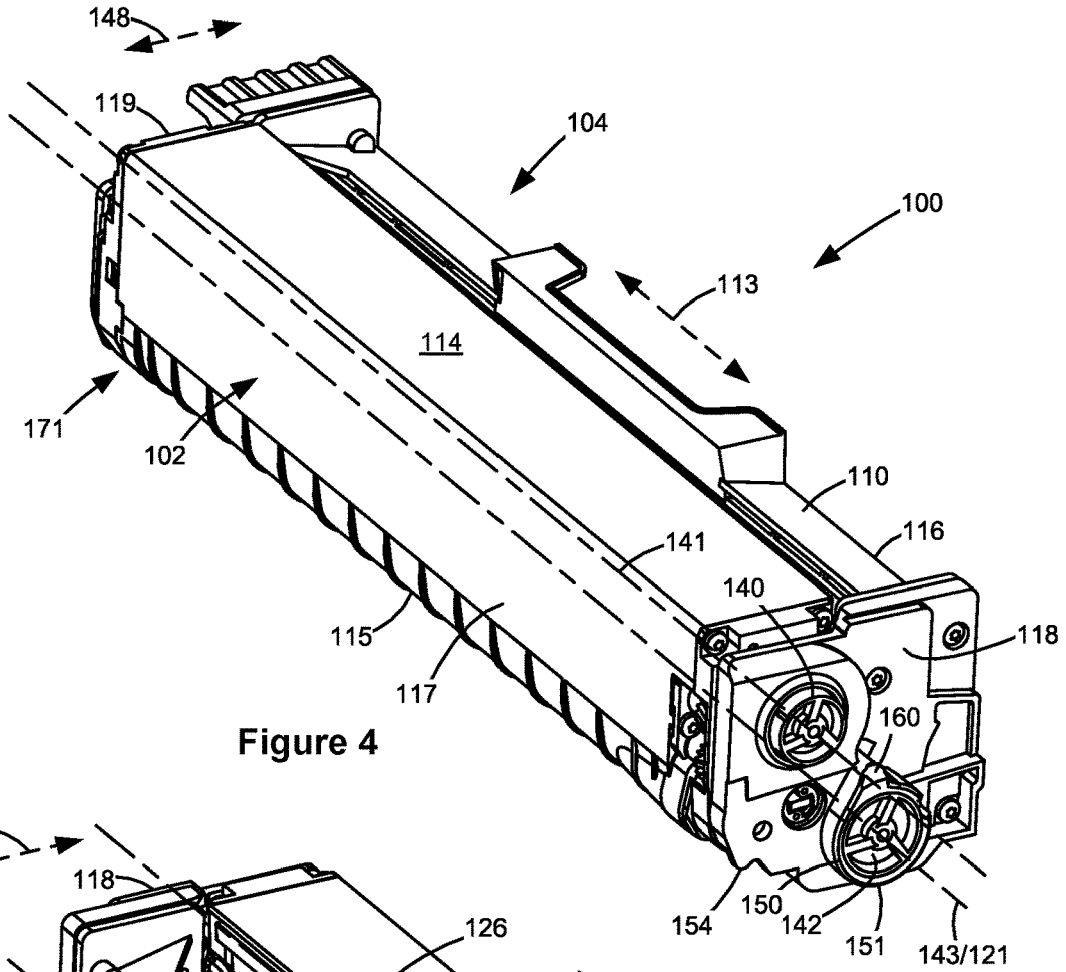
FIGS. 4 and 5 are perspective views of the toner cartridge according to one example embodiment.
Figure 5:
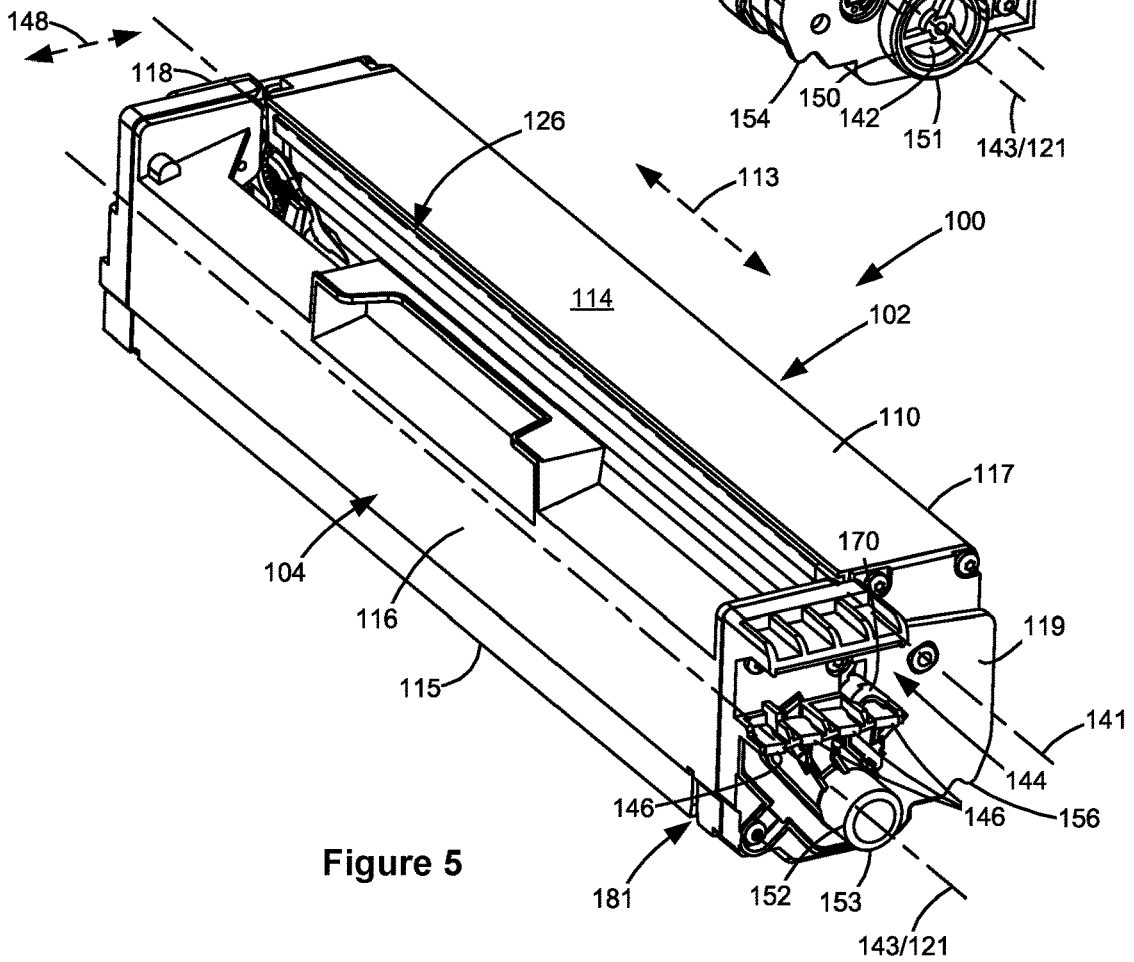

FIGS. 4 and 5 show the exterior of toner cartridge 100 according to one example embodiment. As shown, in this embodiment, developer unit 102 is positioned at side 117 of housing 110 and photoconductor unit 104 is positioned at side 116 of housing 110.

With reference to FIG. 4, in the example embodiment illustrated, a pair of drive couplers 140, 142 are exposed on an outer portion of housing 110 in position to receive rotational force from a corresponding drive system in image forming device 22 when toner cartridge 100 is installed in image forming device 22 to drive rotatable components of developer unit 102 and photoconductive drum 120, respectively. The drive system in image forming device 22 includes one or more drive motors and a drive transmission from the drive motor(s) to a pair of drive couplers that mate with corresponding drive couplers 140, 142 of toner cartridge 100 when toner cartridge 100 is installed in image forming device 22. In the example embodiment illustrated, drive couplers 140, 142 are each exposed on end 118 of housing 110. Each drive coupler 140, 142 includes a rotational axis 141, 143. In the example embodiment illustrated, drive couplers 140, 142 are each configured to mate with and receive rotational motion from the corresponding drive couplers in image forming device 22 at the axial ends of drive couplers 140, 142. Drive coupler 140 is operatively connected (either directly or indirectly through one or more intermediate gears) to rotatable components of developer unit 102 including, for example, developer roll 128, toner adder roll 130 and toner agitator 134, to rotate developer roll 128, toner adder roll 130 and toner agitator 134 upon receiving rotational force from the corresponding drive system in image forming device 22. Drive coupler 142 is operatively connected (either directly as in the embodiment illustrated or indirectly through one or more intermediate gears) to photoconductive drum 120 to rotate photoconductive drum 120 upon receiving rotational force from the corresponding drive system in image forming device 22. In some embodiments, charge roll 122 is driven by friction contact between the surfaces of charge roll 122 and photoconductive drum 120. In other embodiments, charge roll 122 is connected to drive coupler 142 by one or more gears.

With reference to FIG. 5, in the example embodiment illustrated, toner cartridge 100 includes one or more electrical contacts 144 positioned on end 119 of housing 110 and electrically connected to processing circuitry 44 and one or more electrical contacts 146 positioned on end 119 of housing 110 and electrically connected to one or more imaging components of toner cartridge 100. Electrical contacts 144 and 146 are positioned to contact corresponding electrical contacts in image forming device 22 when toner cartridge 100 is installed in image forming device 22 in order to facilitate communications link 51 between processing circuitry 44 and controller 28 and electrical path 56 between the one or more imaging components of toner cartridge 100 and power supply 42. In the example embodiment illustrated, electrical contacts 146 include discrete electrical contacts each electrically connected to one of photoconductive drum 120, charge roll 122, developer roll 128 and toner adder roll 130.

With reference to FIGS. 4 and 5, in the example embodiment illustrated, toner cartridge 100 includes a pair of positioning bosses 150, 152 that each protrude outward away from a respective end 118, 119 of housing 110 at and along a rotational axis 121 of photoconductive drum 120. Boss 150 is positioned on end 118 of housing 110 and at least partially encircles drive coupler 142. Boss 152 is positioned on end 119 of housing 110 at rotational axes 121 and 143 of photoconductive drum 120 and drive coupler 142. Each boss 150, 152 is unobstructed from below permitting the boss 150, 152 to contact and sit in a corresponding V-block in basket 204 when toner cartridge 100 is inserted into a corresponding positioning slot 206 of basket 204 in order to define a vertical position of toner cartridge 100 and a horizontal position of toner cartridge 100 along lateral dimension 148 as discussed in greater detail below. In the example embodiment illustrated, a bottom portion of each boss 150, 152 includes a rounded bottom surface 151, 153, e.g., formed along an arc of a circle, that contacts and sits in the corresponding V-block in basket 204. In the embodiment illustrated, each boss 150, 152 is formed integrally with a respective end 118, 119 of housing 110.

In the example embodiment illustrated, toner cartridge 100 includes a pair of rotational stops 154, 156 that prevent rotation of toner cartridge 100 about an axis parallel to longitudinal dimension 113 of housing 110 when toner cartridge 100 is installed in image forming device 22. Each rotational stop 154, 156 is positioned along the bottom 115 of housing 110 at side 117 of housing 110 at a respective end 118, 119 of housing 110. In the embodiment illustrated, rotational stops 154, 156 are formed by members, such as extensions or feet, that protrude downward from the bottom 115 of housing 110 at ends 118, 119 of housing 110. Each rotational stop 154, 156 is unobstructed from below permitting each rotational stop 154, 156 to contact a corresponding portion of basket 204 when toner cartridge 100 is inserted into a corresponding positioning slot 206 of basket 204 in order to define a rotational position of toner cartridge 100 as discussed in greater detail below. In the embodiment illustrated, each rotational stop 154, 156 is formed integrally with a respective end 118, 119 of housing 110 and corresponding boss 150, 152.

Toner cartridge 100 also includes a pair of hold-down engagement members 160, 170 that each contact a corresponding hold-down in basket 204 and receive a corresponding bias force to maintain contact between bosses 150, 152 of toner cartridge 100 and the corresponding V-blocks in basket 204 and between rotational stops 154, 156 of toner cartridge 100 and the corresponding portions of basket 204 during operation of toner cartridge 100 in image forming device 22 as discussed in greater detail below. Each engagement member 160, 170 is unobstructed from above permitting the corresponding hold-downs in basket 204 to contact engagement members 160, 170 from above in order to apply a downward force on engagement members 160, 170, including, for example, a primarily downward force on engagement members 160, 170.

Figure 6:
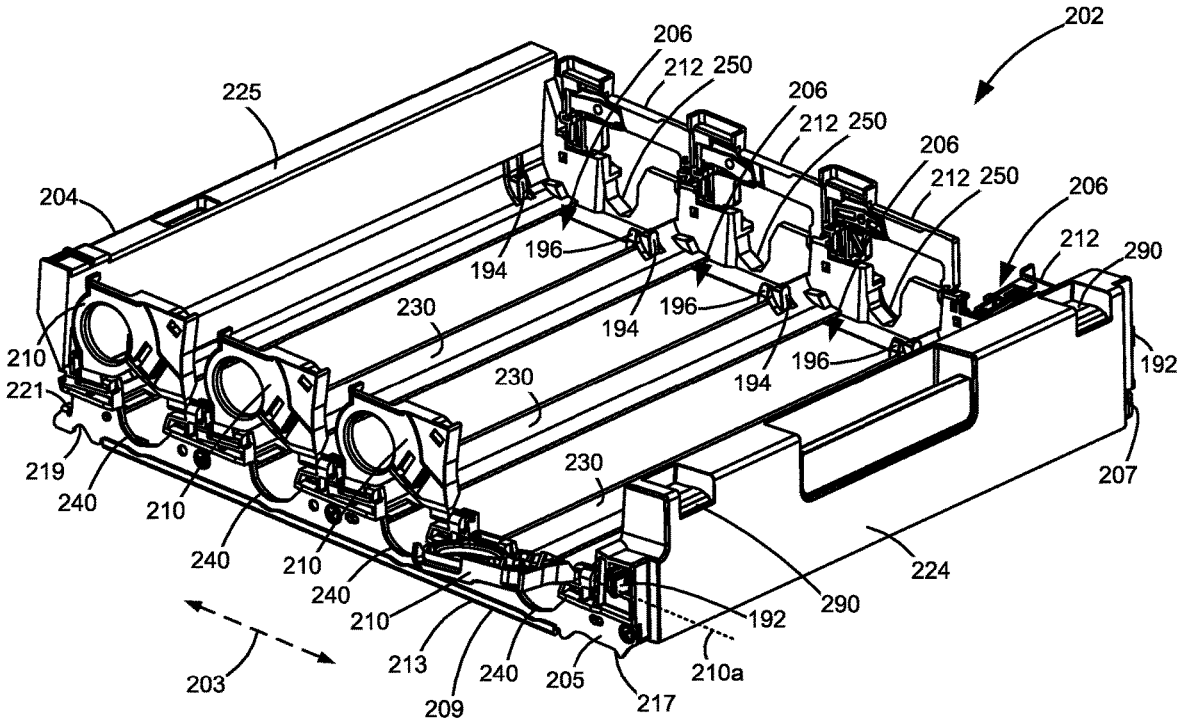
FIGS. 6 and 7 are perspective views of the basket shown in FIG. 3 with no toner cartridges installed therein according to one example embodiment.
Figure 7:
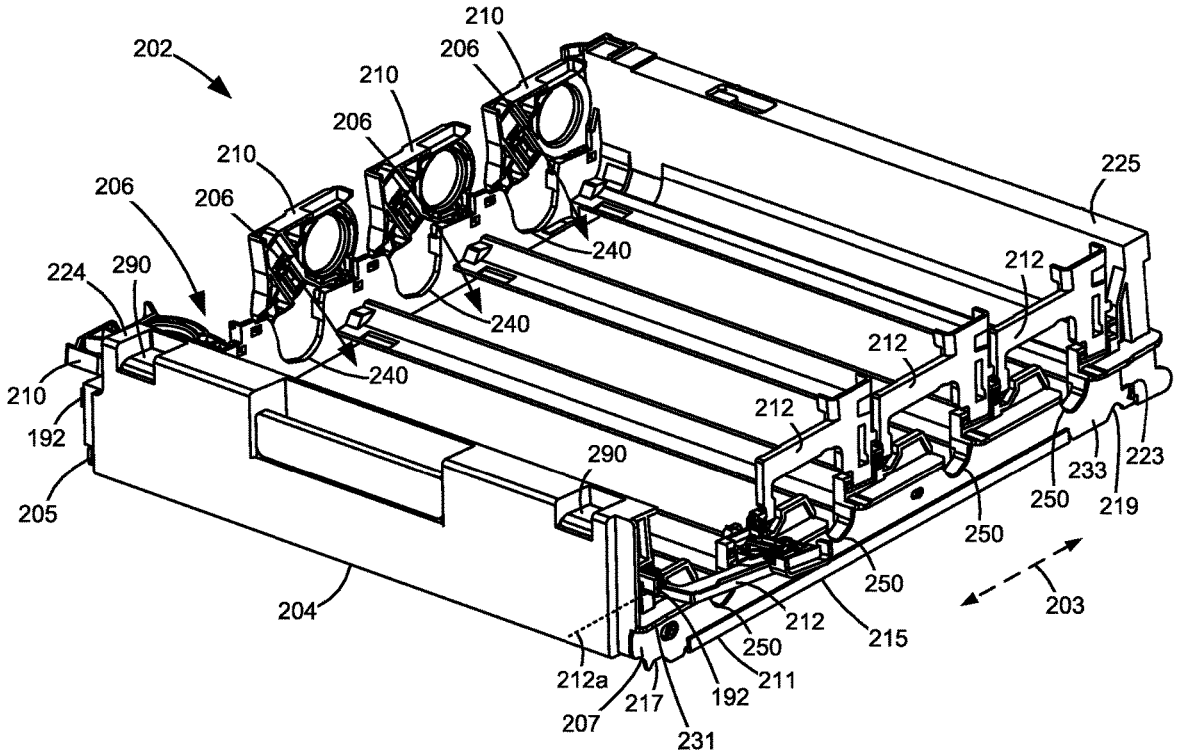

FIGS. 6 and 7 show drawer 202 including basket 204 removed from image forming device 22 with all toner cartridges 100 removed. In the example embodiment illustrated, four positioning slots 206 are configured to receive the four corresponding toner cartridges 100 of image forming device 22. Each positioning slot 206 includes a pair of positioning ribs 194, 196 on opposite sides of the positioning slot 206. Positioning ribs 194, 196 are positioned to enter positioning slots 171, 181 of the corresponding toner cartridge 100 (see FIGS. 4 and 5) when the toner cartridge 100 is installed in a positioning slot 206 of basket 204. In the example embodiment illustrated, basket 204 includes three parallel rails 230 that extend perpendicular to sliding direction 203 of drawer 202, parallel to longitudinal dimension 113 of toner cartridges 100. Rails 230 separate the positioning slots 206 of basket 204 from each other and provide additional rigidity to basket 204.

In the example embodiment illustrated, each positioning slot 206 includes a pair of corresponding latches 210), 212 that secure a toner cartridge 100 in basket 204. One latch 210 is positioned at a first end of the positioning slot 206 proximate to one end 118 of the corresponding toner cartridge 100 and the other latch 212 is positioned at an opposite end of the positioning slot 206 proximate to the opposite end 119 of the corresponding toner cartridge 100. In the example embodiment illustrated, each latch 210, 212 is manually movable between an unlatched position (as illustrated by the pair of corresponding latches 210, 212 of the positioning slot 206 directly adjacent to a front end wall 224 of basket 204 in FIGS. 6 and 7) and a latched position (as illustrated by each of the remaining three pairs of corresponding latches 210, 212 in FIGS. 6 and 7) permitting a user to selectively secure a particular toner cartridge 100 to basket 204 or remove a particular toner cartridge 100 from basket 204. In FIG. 3, toner cartridges 100 are installed in their corresponding positioning slots 206 in basket 204 with the corresponding latches 210, 212 in latched positions securing toner cartridges 100 in basket 204. In this embodiment, latches 210, 212 are pivotable between their latched and unlatched positions about respective pivot axes 210*a*, 212*a* that run along sliding direction 203 of drawer 202; however, latches 210, 212 may move in other manners as desired.

In the example embodiment illustrated, each positioning slot 206 includes a pair of V-blocks 240, 250 that are positioned to receive corresponding bosses 150, 152 of toner cartridge 100 when the toner cartridge 100 is installed in a positioning slot 206 of basket 204. V-block 240 is positioned at a first end of the positioning slot 206 proximate to one end 118 of the corresponding toner cartridge 100 and the other V-block 250 is positioned at an opposite end of the positioning slot 206 proximate to the opposite end 119 of the corresponding toner cartridge 100.

In the example embodiment illustrated, each side 205, 207 of basket 204 has a corresponding bottom portion 209, 211 that each extends along a lengthwise dimension of drawer 202 parallel to sliding direction 203 of drawer 202. Each of the corresponding bottom portions 209, 211 of sides 205, 207 of basket 204 includes a corresponding sliding edge or surface 213, 215 that is slidable along corresponding guide rails provided in image forming device 22 to assist with insertion and removal of basket 204 into/from image forming device 22 as described in greater detail below. Each bottom portion 209, 211 of sides 205, 207 of basket 204 also includes a recessed locator 217 and a V-block 219 that are unobstructed from below permitting each recessed locator 217 and V-block 219 to contact and sit in a corresponding boss in image forming device 22 when drawer 202 is in the operational position to define a horizontal position of drawer 202 along sliding direction 203 and a vertical position of drawer 202, also described in greater detail below. Recessed locators 217 along the corresponding bottom portions 209, 211 of each side 205, 207 of basket 204 are positioned adjacent to front end wall 224 of basket 204. V-blocks 219 along the corresponding bottom portions 209, 211 of each side 205, 207 of basket 204 are positioned adjacent to a rear end wall 225 of basket 204.

Figure 8:
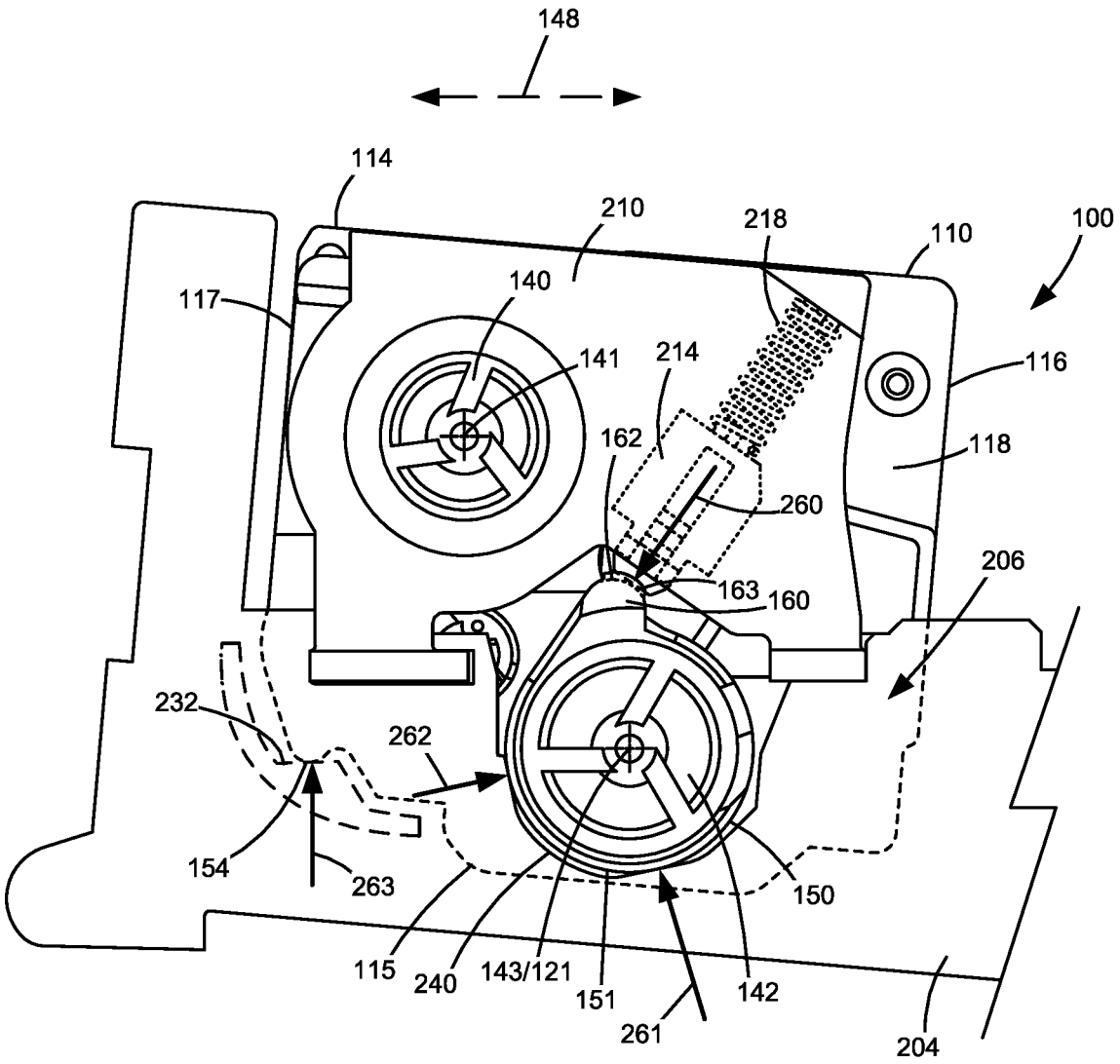
FIG. 8 is a first side elevation view of the toner cartridge of FIGS. 4 and 5 installed in the basket of FIGS. 6 and 7 according to one example embodiment.
Figure 9:
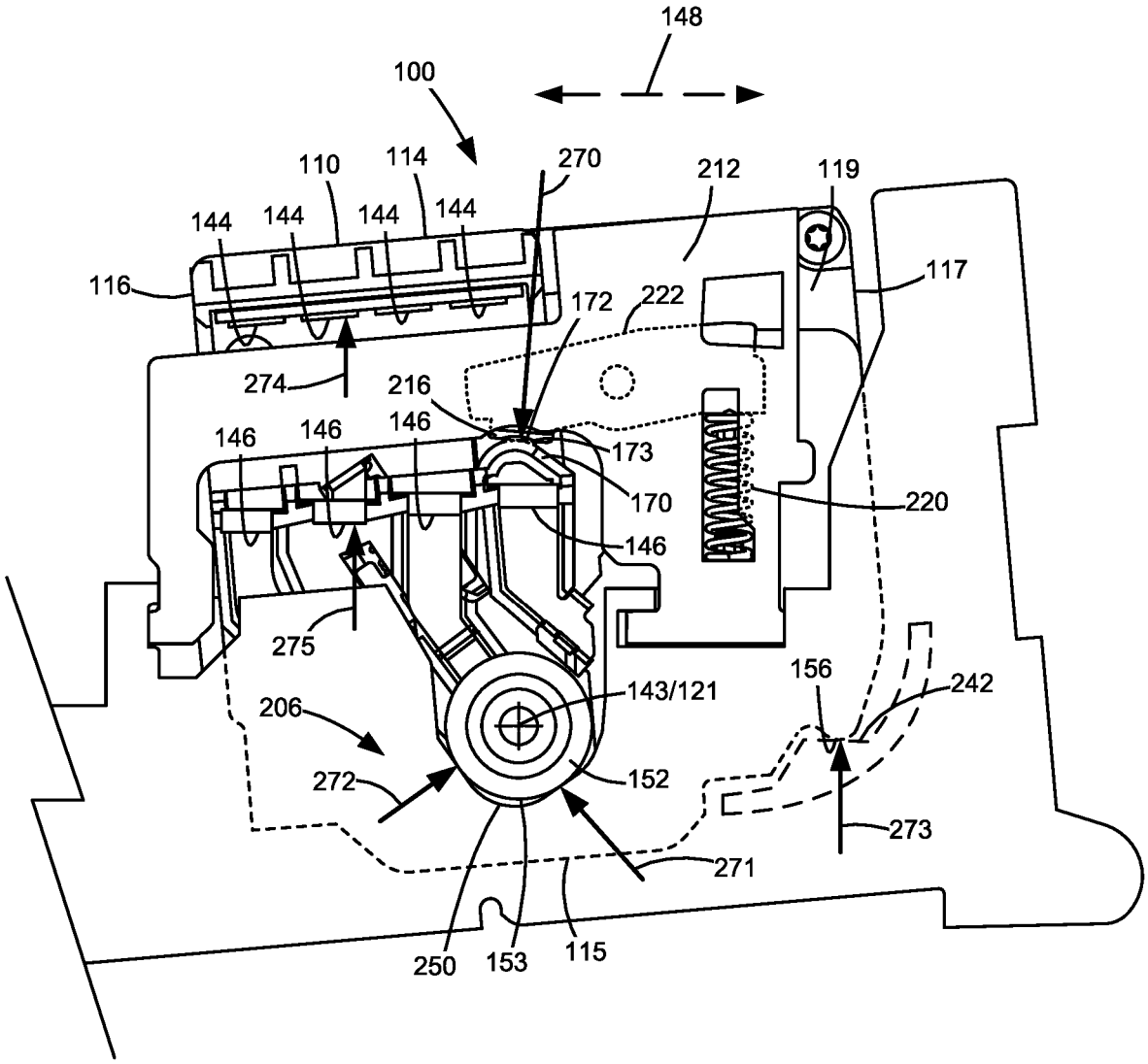
FIG. 9 is a second side elevation view of the toner cartridge of FIGS. 4 and 5 installed in the basket of FIGS. 6 and 7 according to one example embodiment.

FIGS. 8 and 9 show ends 118, 119 of toner cartridge 100, respectively, with toner cartridge 100 installed in a positioning slot 206 of basket 204 with latches 210, 212 engaged with engagement members 160, 170 of toner cartridge 100 according to one example embodiment. Each latch 210, 212 includes a respective hold-down 214, 216 that contacts a corresponding engagement member 160, 170 of toner cartridge 100. Each hold-down 214, 216 is biased by a respective biasing member 218, 220 to supply a hold-down force to the corresponding engagement member 160, 170 of toner cartridge 100. For purposes of clarity, FIGS. 8 and 9 show portions of each hold-down 214, 216 and biasing member 218, 220 that are obscured by latches 210, 212 in broken line. In the example embodiment illustrated, each biasing member 218, 220 includes a compression spring; however, any suitable biasing member may be used as desired, such as, for example, an extension spring, a torsion spring, a leaf spring or a material having resilient properties. In the example embodiment illustrated, hold-down 214 is translatable along a biasing direction of biasing member 218 and hold-down 216 includes a pivotable bell-crank 222 biased by biasing member 220; however, each hold-down 214, 216 may be directly or indirectly biased according to any suitable method as desired.

FIG. 8 shows hold-down 214 of latch 210 in contact with a contact surface 162 of engagement member 160 and FIG. 9 shows hold-down 216 of latch 212 in contact with a contact surface 172 of engagement member 170. Hold-downs 214, 216 each apply a downward hold-down force 260, 270 to engagement members 160, 170 at ends 118, 119 of toner cartridge 100 as a result of the bias forces supplied by biasing members 218, 220. In particular, in the example embodiment illustrated, the direction of hold-down force 260 is primarily downward toward bottom 115 of housing 110 and also toward side 117 of housing 110 and the direction of hold-down force 270 is primarily downward toward bottom 115 of housing and also slightly toward side 116 of housing 110. Forces 260, 270 applied by hold-downs 214, 216 to engagement members 160, 170 aid in retaining bosses 150, 152 of toner cartridge 100 against corresponding V-blocks 240, 250 of positioning slot 206. Contact between bosses 150, 152 and V-blocks 240, 250 defines a horizontal position of toner cartridge 100 along lateral dimension 148 and a vertical position of toner cartridge 100. In particular, contact between bosses 150, 152 and V-blocks 240, 250 defines a horizontal position of photoconductive drum 120 along lateral dimension 148 and a vertical position of photoconductive drum 120 in order to ensure that the toned image from photoconductive drum 120 is accurately transferred to the print media or intermediate transfer member. In this manner, forces 260, 270 applied by hold-downs 214, 216 to engagement members 160, 170 aid in preventing toner cartridge 100 from shifting horizontally along lateral dimension 148 or vertically during operation of toner cartridge 100 in image forming device 22. Forces 260, 270 applied by hold-downs 214, 216 to engagement members 160, 170 also aid in retaining rotational stops 154, 156 of toner cartridge 100 against corresponding frame surfaces 232, 242 of basket 204. For purposes of clarity, FIGS. 8 and 9 show rotational stops 154, 156 and frame surfaces 232, 242, which are obscured by outer portions of basket 204 in FIGS. 8 and 9, in broken line. Contact between rotational stops 154, 156 and frame surfaces 232, 242 defines a rotational position of toner cartridge 100. In this manner, forces 260, 270 applied by hold-downs 214, 216 to engagement members 160, 170 aid in preventing toner cartridge 100 from rocking during operation of toner cartridge 100 in image forming device 22.

With reference to FIG. 8, hold-down force 260 applied by hold-down 214 to engagement member 160 overcomes reaction forces 261, 262 from V-block 240 on boss 150 and reaction force 263 from frame surface 232 on rotational stop 154 at end 118 of toner cartridge 100, in addition to other less significant horizontal forces along lateral dimension 148 and vertical forces on toner cartridge 100, in order to retain boss 150 in V-block 240 and rotational stop 154 against frame surface 232. Similarly, with reference to FIG. 9, hold-down force 270 applied by hold-down 216 to engagement member 170 overcomes reaction forces 271, 272 from V-block 250 on boss 152 and reaction force 273 from frame surface 242 on rotational stop 156 as well as forces 274, 275 applied to electrical contacts 144, 146 by corresponding electrical contacts in image forming device 22 at end 119 of toner cartridge 100, in addition to other less significant horizontal forces along lateral dimension 148 and vertical forces on toner cartridge 100, in order to retain boss 152 in V-block 250 and rotational stop 156 against frame surface 242.

FIGS. 8 and 9 also show hold-downs 214, 216 positioned behind catches 163, 173 of engagement members 160, 170 such that catches 163, 173 aid in retaining latches 210, 212 in their latched positions proximate to ends 118, 119 of toner cartridge 100 when toner cartridge 100 is installed in positioning slot 206. For purposes of clarity, FIGS. 8 and 9 show contact surfaces 162, 172 of engagement members 160, 170 and corresponding contact portions of hold-downs 214, 216, which are obscured by catches 163, 173 of engagement members 160, 170 in FIGS. 8 and 9, in broken line. In some embodiments, a snap fit engagement is provided between each latch 210, 212 and corresponding side 205, 207 of basket 204 that aids in retaining each latch 210, 212 in the latched position when toner cartridge 100 is installed in positioning slot 206, and that holds each latch 210, 212 upright when no toner cartridge is installed in a positioning slot 206. In order to unlatch toner cartridge 100 from basket 204, a user grasps a top end of each latch 210, 212 and manually pivots latches 210, 212 outward away from ends 118, 119 of toner cartridge 100 and downward from the latched positions of latches 210, 212 to the unlatched positions of latches 210, 212. As latches 210, 212 pivot toward their unlatched positions, hold-downs 214, 216 move relative to latches 210, 212 counter to the bias supplied by biasing members 218, 220 as hold-downs 214, 216 pass over catches 163, 173 of engagement members 160, 170 permitting hold-downs 214, 216 to clear catches 163, 173. Once toner cartridge 100 is unlatched, a user may simply lift toner cartridge 100 from basket 204 in order to remove toner cartridge 100. Similarly, in order to latch toner cartridge 100 to basket 204, a user grasps each latch 210, 212 and manually pivots latches 210, 212 inward toward ends 118, 119 of toner cartridge 100 and upward from the unlatched positions of latches 210, 212 to the latched positions of latches 210, 212. As latches 210, 212 pivot toward their latched positions, hold-downs 214, 216 move relative to latches 210, 212 counter to the bias supplied by biasing members 218, 220 as hold-downs 214, 216 pass over catches 163, 173 of engagement members 160, 170 permitting hold-downs 214, 216 to clear catches 163, 173 in order to engage contact surfaces 162, 172 of engagement members 160, 170 to retain toner cartridge 100 in positioning slot 206 as discussed above.

The engagement between positioning slots 171, 181 of toner cartridge 100 and corresponding positioning ribs 194, 196 of basket 204 provides independent positioning of developer unit 102 and photoconductor unit 104 along longitudinal dimension 113 of housing 110. Independently locating developer unit 102 and photoconductor unit 104 to basket 204 helps minimize the tolerance stack up between developer unit 102 and photoconductor unit 104 and basket 204 (and, in turn, between developer unit 102 and photoconductor unit 104 and the frame of image forming device 22) along longitudinal dimension 113 of housing 110 (i.e., along axial dimensions of photoconductive drum 120, developer roll 128 and toner adder roll 130). Minimizing the tolerance stack up along longitudinal dimension 113 permits the use of shorter imaging components in toner cartridge 100, such as developer roll 128 and photoconductive drum 120, and a shorter overall toner cartridge 100 along longitudinal dimension 113 which, in turn, permits a smaller footprint for image forming device 22 in accordance with consumer preferences for more compact devices and components.

Figure 10A:
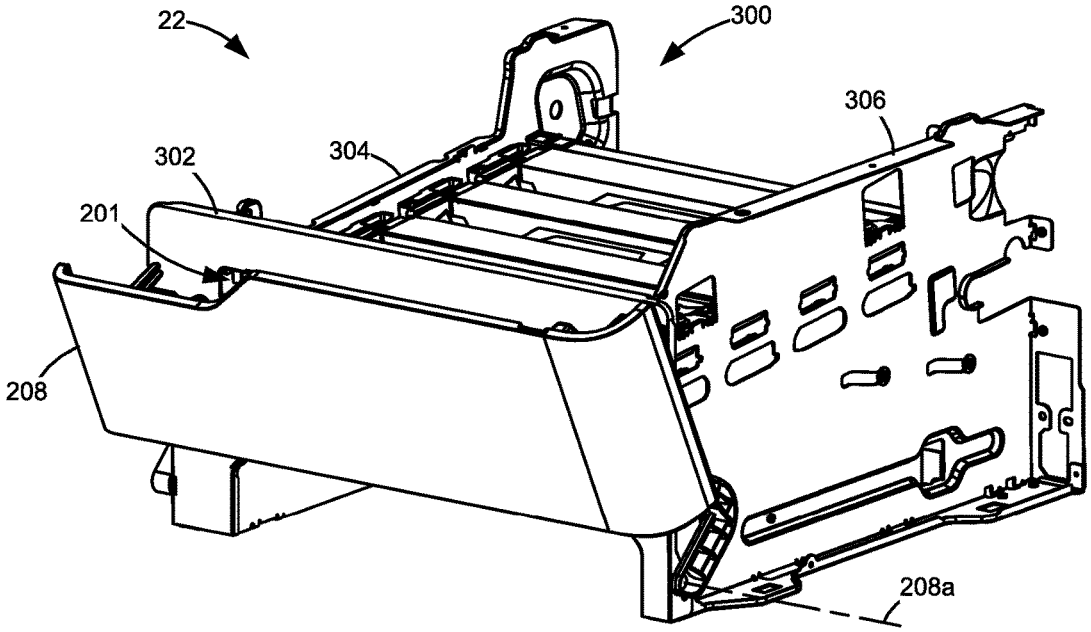
FIGS. 10A-10C are perspective views showing the image forming device of FIG. 3 with its covers removed to show the drawer disposed within a frame assembly according to one example embodiment.
Figure 10B:
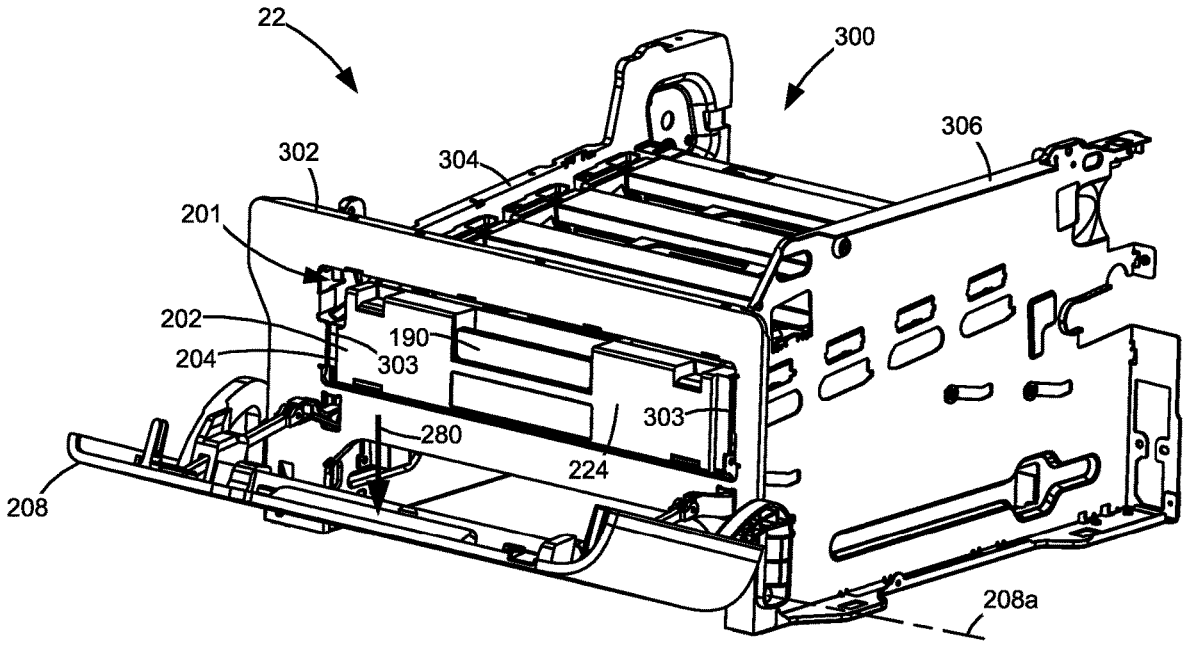
Figure 10C:
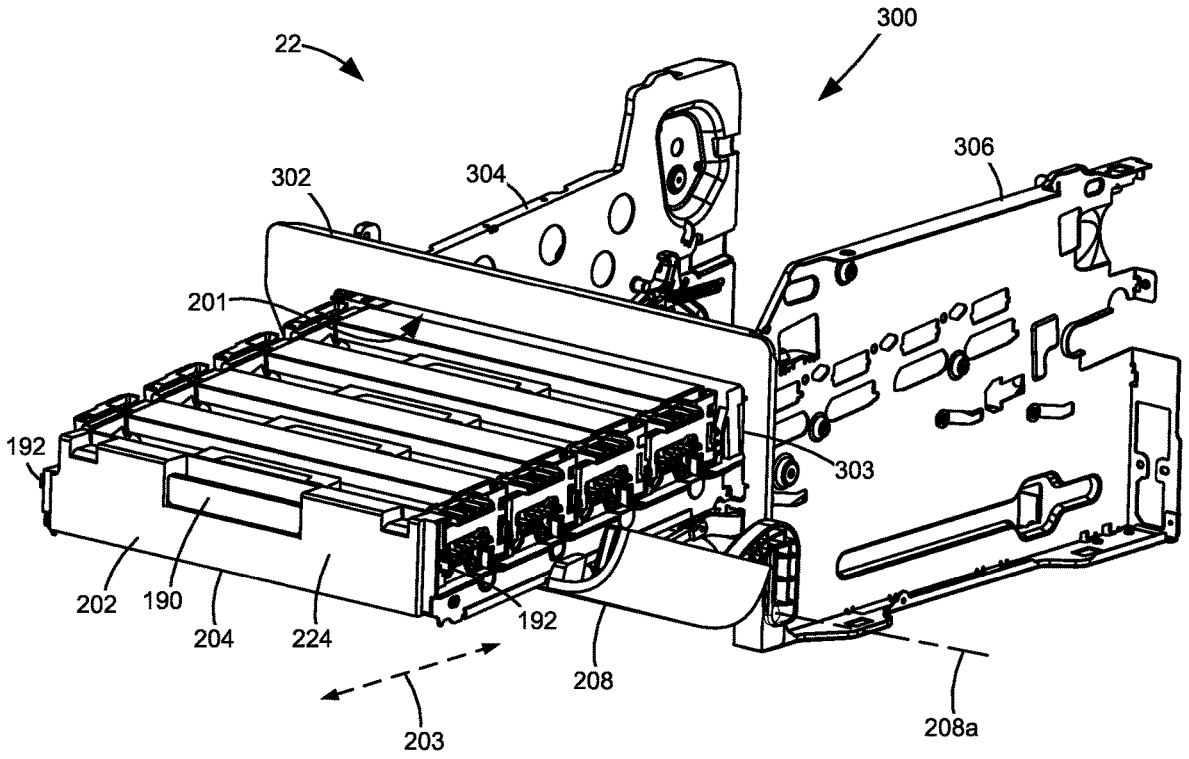

FIGS. 10A-10C illustrate image forming device 22 with its covers removed to show drawer 202 disposed within a frame assembly 300 according to one example embodiment. Frame assembly 300 includes a front panel 302 and opposed side panels, shown as left and right side panels 304, 306. From a closed position relative to opening 201 of front panel 302, access door 208 is rotatable downward about a pivot axis 208*a* adjacent its bottom edge to an initial open position as shown in FIG. 10A. In one example embodiment, access door 208 freely falls downward from the closed position to the initial open position upon releasing a latch (not shown) that holds access door 208 in the closed position. From the initial open position shown in FIG. 10A, access door 208 is further rotatable downward upon receiving a downward force 280 from a user until access door 208 reaches a final open position shown in FIG. 10B. When access door 208 is in the final open position, drawer 202 is slidable between left and right side panels 304, 306 along sliding direction 203 through opening 201 of front panel 302 as shown in FIG. 10C.

Figure 11:
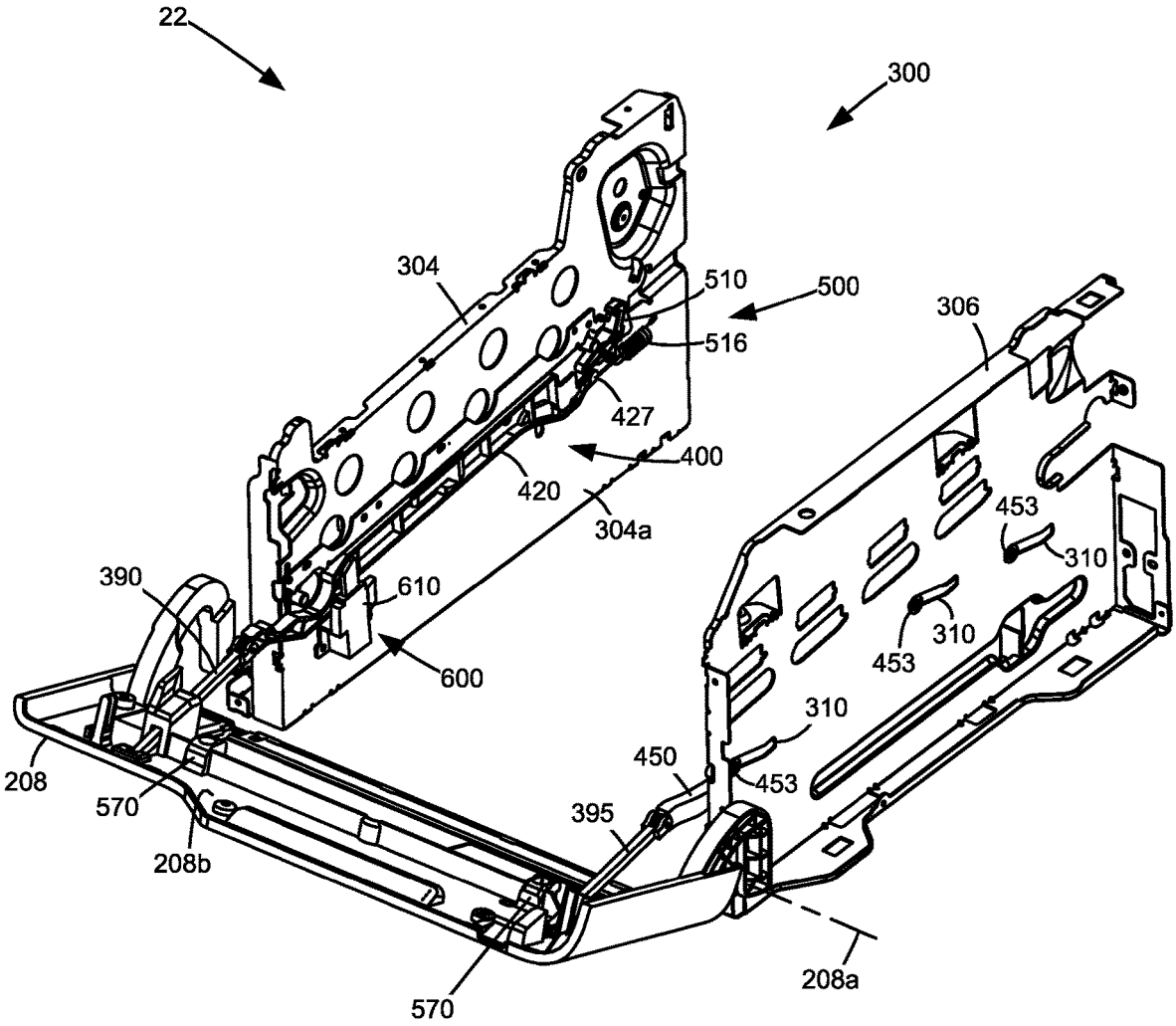
FIGS. 11 and 12 are perspective views of the frame assembly with the drawer removed to show a movable guide rail assembly operatively connected to an access door, a latch assembly, and a rail lock assembly according to one example embodiment.
Figure 12:
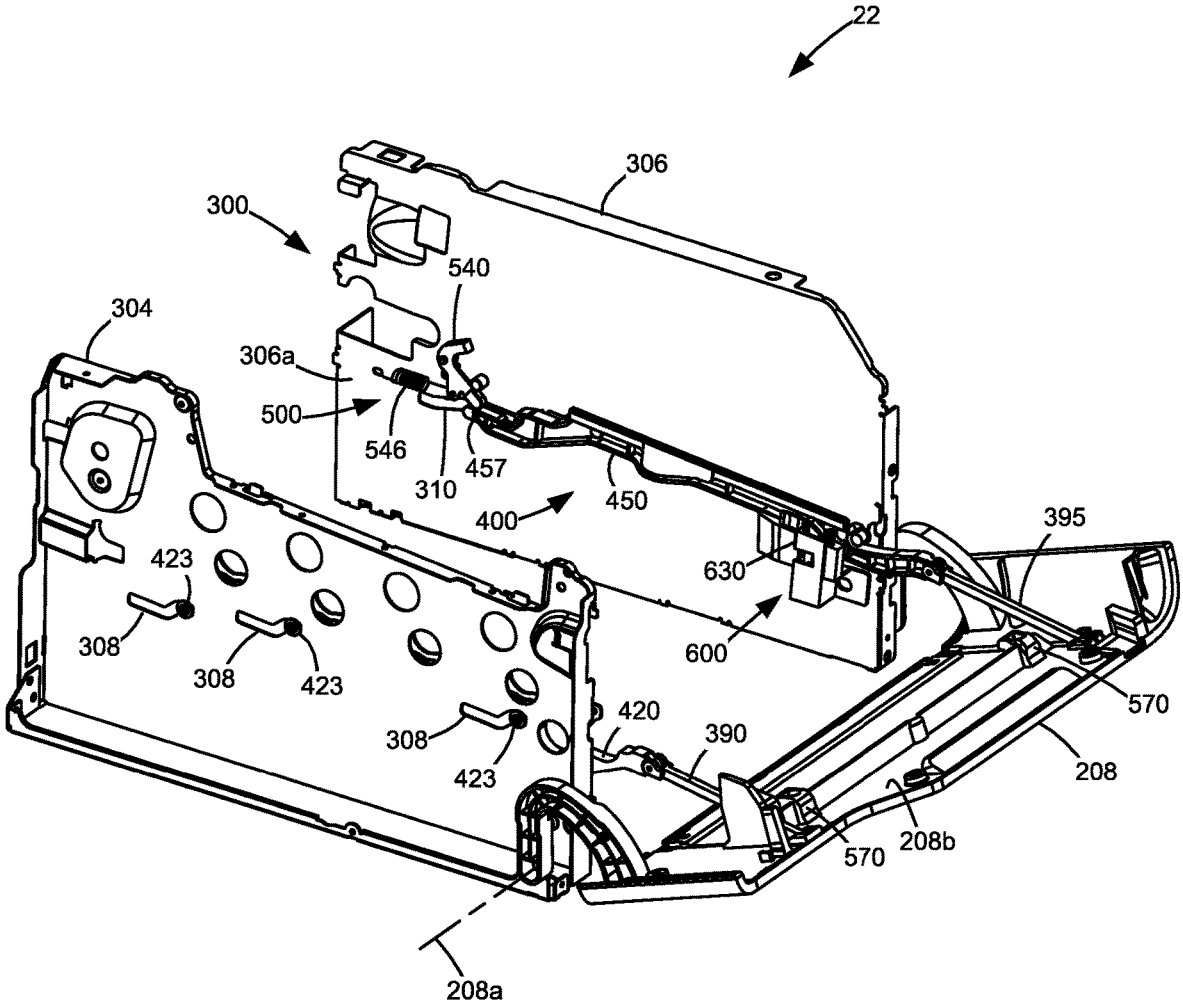

FIGS. 11 and 12 illustrate frame assembly 300 with drawer 202 removed to show a movable guide rail assembly 400 mounted on frame assembly 300 according to one example embodiment. Guide rail assembly 400 is positioned to slidably support drawer 202 when access door 208 is in the final open position. In the example embodiment illustrated, guide rail assembly 400 includes left and right guide rails 420, 450 movably positioned on respective inner side walls 304*a*, 306*a* of left and right side panels 304, 306. Left and right guide rails 420, 450 are operatively connected to access door 208 via corresponding linkages 390, 395. Linkages 390, 395 allow access door 208 to move guide rail assembly 400 between a lowered position and a raised position as access door 208 moves between the initial open position (FIG. 10A) and the final open position (FIG. 10B), respectively. In the lowered position, left and right guide rails 420, 450 are spaced below and free from contact with basket 204. In the raised position, left and right guide rails 420, 450 contact and raise basket 204 such that basket 204 is slidable along left and right guide rails 420, 450, as discussed in greater detail below.

Figure 13:
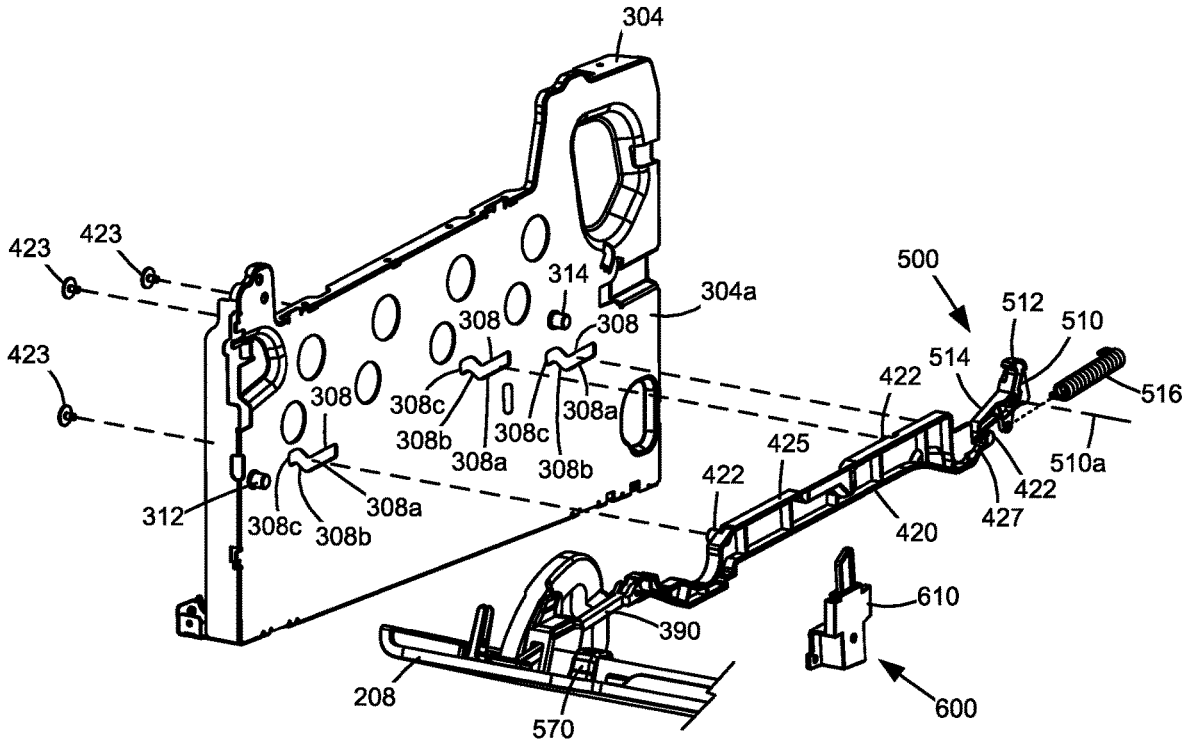
FIGS. 13 and 14 are exploded views showing left and right guide rails of the guide rail assembly operatively connected to the access door, left and right latches of the latch assembly, and left and right plungers of the rail lock assembly of FIGS. 11 and 12, respectively, according to one example embodiment.
Figure 14:
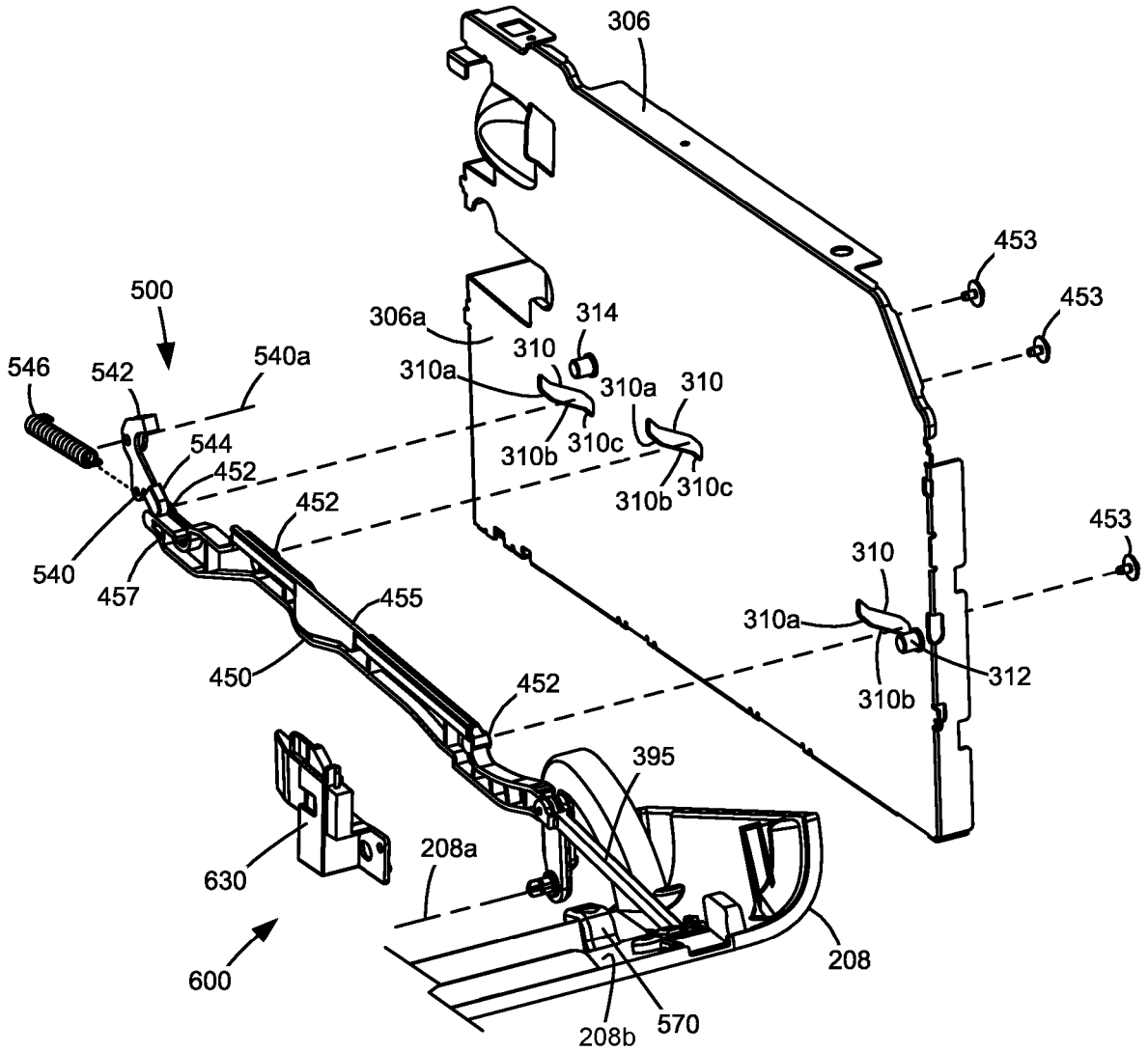

FIG. 13 is an exploded view showing left guide rail 420 relative to left side panel 304 and FIG. 14 is an exploded view showing right guide rail 450 relative to right side panel 306. In the example embodiment illustrated, left side panel 304 includes guide slots 308 for receiving corresponding slide pins 422 of left guide rail 420 and right side panel 306 includes guide slots 310 for receiving corresponding slide pins 452 of right guide rail 450. Each slide pin 422, 452 is positioned to slidably travel along corresponding guide slots 308, 310. Fasteners 423, 453 are attached to corresponding slide pins 422, 452 to retain left guide rail 420 against left side panel 304 and right guide rail 450 against right side panel 306. Each guide slot 308, 310 has a corresponding lower dwell 308*a*, 310*a*, a ramped section 308*b*, 310*b*, and an upper dwell 308*c*, 310*c*. Slide pins 422, 452 rest on corresponding lower dwells 308*a*, 310*a* of guide slots 308, 310 when each of left and right guide rails 420, 450 is in the lowered position. When each of left and right guide rails 420, 450 is in the raised position, slide pins 422, 452 rest on corresponding upper dwells 308*c*, 310*c* of guide slots 308, 310. Slide pins 422, 452 travel along corresponding ramped sections 308*b*, 310*b* as left and right guide rails 420, 450 transition between the lowered position and the raised position. Left guide rail 420 includes a left guide rail surface 425 that contacts sliding surface 213 of side 205 of basket 204 and right guide rail 450 includes a right guide rail surface 455 that contacts sliding surface 215 of side 207 of basket 204 when left and right guide rails 420, 450 are in the raised positions to slidably support basket 204. The operation of guide rail assembly 400 is discussed in greater detail below.

In the example embodiment illustrated in FIGS. 11-14, a latch assembly 500 is mounted on inner side walls 304*a*, 306*a* of left and right side panels 304, 306. Latch assembly 500 is positioned to provide bias forces against basket 204 to maintain contact between rear V-blocks 219 of each side 205, 207 of basket 204 and corresponding bosses 314 on left and right side panels 304, 306 (FIGS. 13 and 14) when basket 204 is in the operational position within image forming device 22. In the embodiment illustrated in FIGS. 11 and 13, latch assembly 500 includes a left latch 510 positioned on inner side wall 304*a* of left side panel 304 adjacent a rear end 427 of left guide rail 420. In the embodiment illustrated in FIGS. 12 and 14, latch assembly 500 includes a right latch 540 positioned on inner side wall 306*a* of right side panel 306 adjacent a rear end 457 of right guide rail 450. Left and right latches 510, 540 are pivotable about respective pivot axes 510*a*, 540*a* between a latched position to retain and hold down basket 204 in the operational position and an unlatched position to disengage and release basket 204.

In the example embodiment illustrated, left latch 510 includes a head 512 extending upward from pivot axis 510*a* toward basket 204 and a leg 514 extending downward from pivot axis 510*a* toward left guide rail 420. Right latch 540 includes an arm 542 extending from pivot axis 540*a* toward basket 204 and a leg 544 extending downward from pivot axis 540*a* toward right guide rail 450. Legs 514, 544 of left and right latches 510, 540 are unobstructed from below permitting rear end portions 427, 457 of left and right guide rails 420, 450 to contact legs 514, 544, respectively, when left and right guide rails 420, 450 move between the lowered position and the raised position.

In the latched position, head 512 of left latch 510 engages a corresponding latch catch 221 (see FIG. 6) positioned on side 205 of basket 204 adjacent to rear end wall 225 of basket 204 while leg 514 of left latch 510 is free from contact with left guide rail 420. Also, in the latched position, arm 542 of right latch 540 engages a corresponding latch catch 223 (see FIG. 7) positioned on side 207 of basket 204 adjacent to rear end wall 225 of basket 204 while leg 544 of right latch 540 is free from contact with right guide rail 450. In the example embodiment illustrated, left and right latches 510, 540 are biased towards the latched position by extension springs 516, 546, respectively. Alternatively, a torsion spring may be positioned about each of pivot axes 510*a*, 540*a* to supply the bias. In the unlatched position, legs 514, 544 are rotated in a direction against the biasing forces of extensions springs 516, 546 causing head 512 of left latch 510 and arm 542 of right latch 540 to disengage from corresponding latch catches 221, 223 of basket 204. The operation of latch assembly 500 is discussed in greater detail below.

In the embodiment illustrated in FIGS. 11-14, access door 208 includes a pair of hold-down features 570 that project from the inner wall 208*b* of access door 208. In the example embodiment illustrated, each hold-down feature 570 contacts a corresponding spring-biased pad 290 (see FIGS. 6 and 7) positioned on front end wall 224 of basket 204 to hold down basket 204 and maintain contact between recessed locators 217 at each side 205, 207 of basket 204 and corresponding bosses 312 on left and right side panels 304, 306 (FIGS. 13 and 14) when basket 204 is in the operational position within image forming device 22 and access door 208 is closed.

Referring to FIGS. 15-18, the operation of guide rail assembly 400 and latch assembly 500 will be described according to one example embodiment. FIGS. 15A-15E are side elevation views showing various positions of access door 208, left guide rail 420 and basket 204 while FIGS. 16A-16E are side elevation views showing various positions of left guide rail 420, left latch 510, and basket 204 corresponding to the positions shown in FIGS. 15A-15E, respectively. FIGS. 17A-17E are side elevation views showing various positions of access door 208, right guide rail 450, and basket 204 while FIGS. 18A-18E are side elevation views showing various positions of right guide rail 450, right latch 540, and basket 204 corresponding to the positions shown in FIGS. 17A-17E, respectively.

Figure 15A:
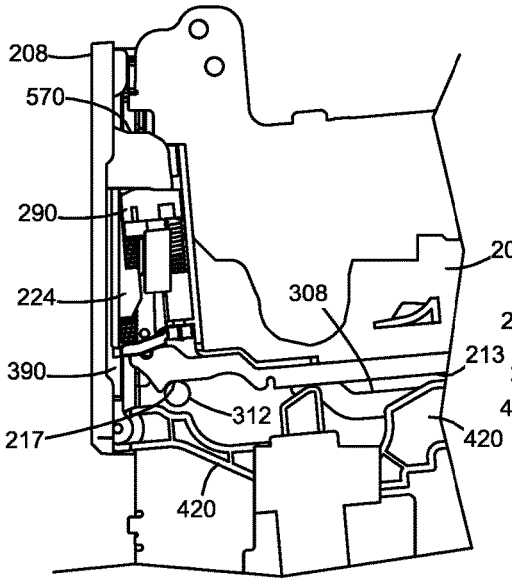
FIGS. 15A-15E are side elevation views showing various positions of the access door, the left guide rail and the basket according to one example embodiment.
Figure 16A:
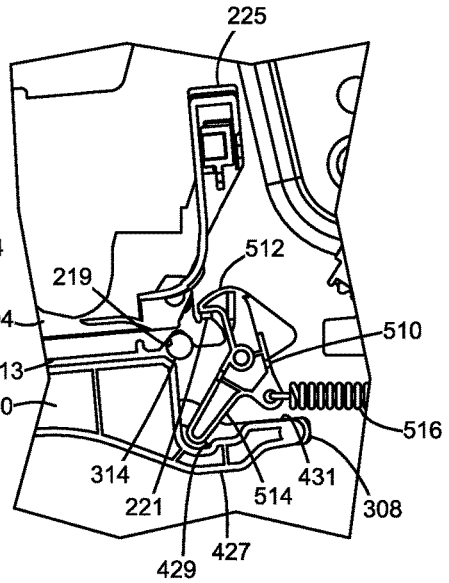
FIGS. 16A-16E are side elevation views showing various positions of the left guide rail, the left latch, and the basket corresponding to the positions shown in FIGS. 15A-15E, respectively, according to one example embodiment.
Figure 18A:
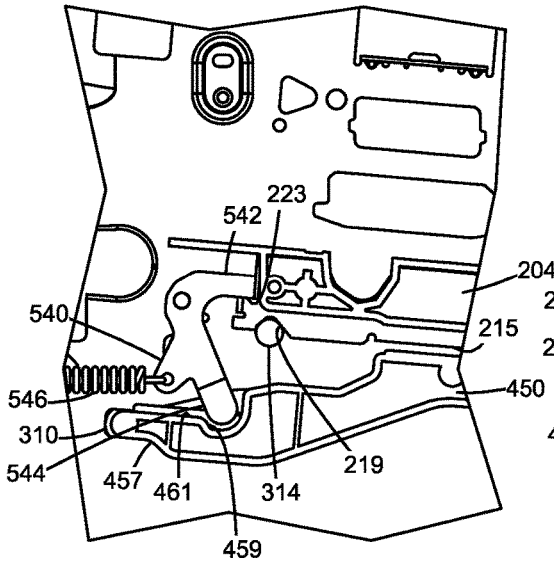
FIGS. 18A-18E are side elevation views showing various positions of the right guide rail, the right latch, and the basket corresponding to the positions shown in FIGS. 17A-17E, respectively, according to one example embodiment.
Figure 17A:
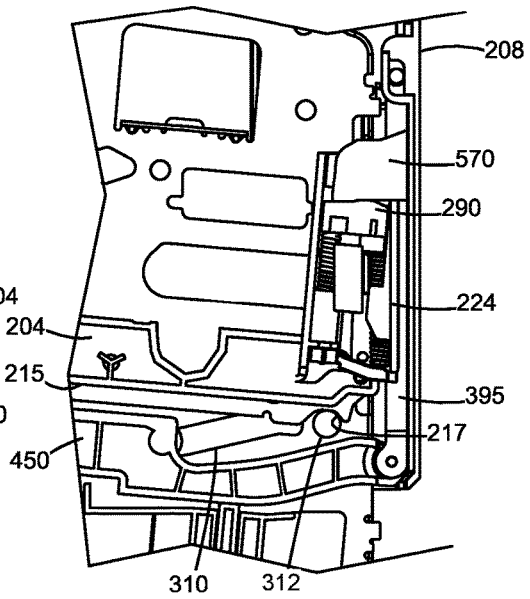
FIGS. 17A-17E are side elevation views showing various positions of the access door, the right guide rail, and the basket according to one example embodiment.

In FIGS. 15A, 16A and FIGS. 17A, 18A, access door 208 is closed and basket 204 is in the operational position within image forming device 22. Hold-down features 570 of access door 208 apply downward bias to corresponding spring-biased pads 290 on front end wall 224 of basket 204 to maintain contact between recessed locators 217 of basket 204 and corresponding bosses 312 in image forming device 22, as shown in FIGS. 15A and 17A. Left and right latches 510, 540 on left and right side panels 304, 306 are in their respective latched positions, as shown in FIGS. 16A and 18A, with head 512 of left latch 510 and arm 542 of right latch 540 applying downward bias to corresponding latch catches 221, 223 of basket 204 due to the biasing forces of springs 516, 546 to maintain contact between V-blocks 219 of basket 204 and corresponding bosses 314 in image forming device 22. In the example embodiment illustrated, legs 514, 544 of left and tight latches 510, 540 are free from contact with left and right guide rails 420, 450, respectively, while left and right guide rails 420, 450 are in their lowered positions.

Figure 15B:
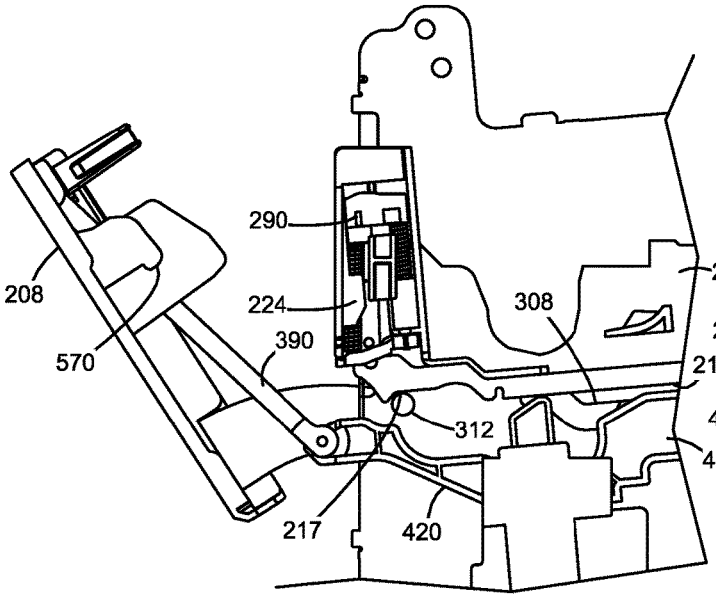
Figure 16B:
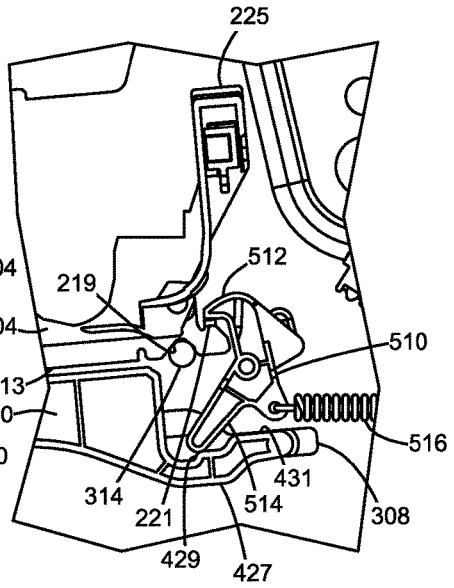
Figure 18B:
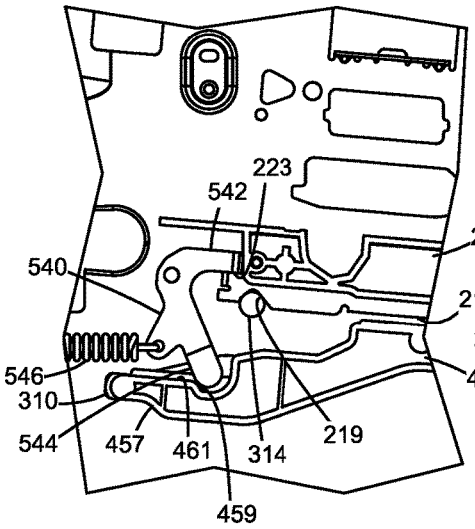
Figure 17B:
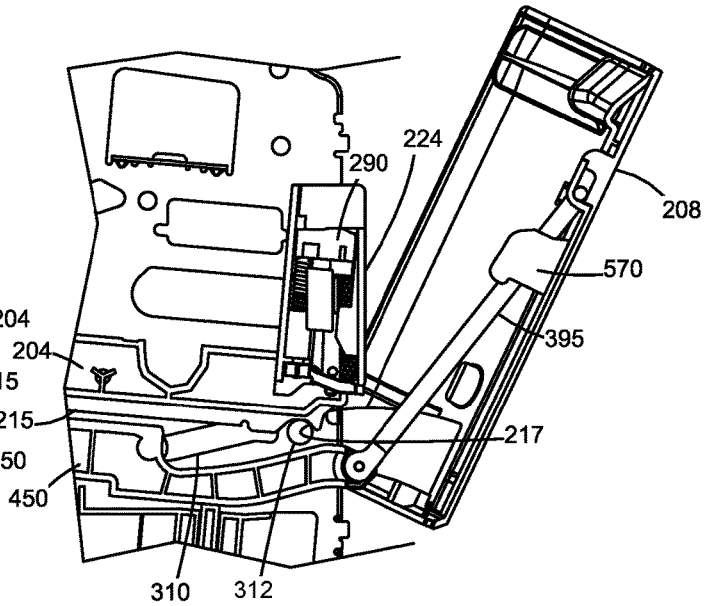
Figure 18C:
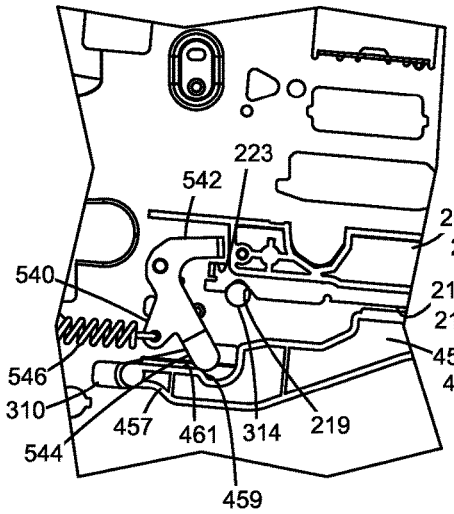

As access door 208 moves from the closed position to the initial open position shown in FIGS. 15B and 17B, hold-down features 570 on access door 208 disengage from corresponding spring-biased pads 290 on front end wall 224 of basket 204 releasing the front portion of basket 204. Left and right guide rails 420, 450 remain in their respective lowered positions. Left and right latches 510, 540 also remain in their respective latched positions, as shown in FIGS. 16B and 18B, holding down the rear portion of basket 204 to maintain contact between V-blocks 219 of basket 204 and corresponding bosses 314 in image forming device 22. Movement of access door 208 from the closed position to the initial open position causes left and right guide rails 420, 450 to slightly move forward (toward access door 208) until rear ends 427, 457 of left and right guide rails 420, 450 contact legs 514, 544 of left and right latches 510, 540, respectively. In the embodiment illustrated in FIG. 16B, leg 514 of left latch 510 contacts an angled surface 429 of rear end 427 of left guide rail 420. In the embodiment illustrated in FIG. 18B, leg 544 of tight latch 540 contacts an angled surface 459 of rear end 457 of right guide rail 450. The biasing forces of springs 516, 546 acting on left and right latches 510, 540 prevent left and right guide rails 420, 450 from further moving forward as legs 514, 544 of left and right latches 510, 540 remain in contact with corresponding angled surfaces 429, 459 of left and right guide rails 420, 450, respectively, causing access door 208 to remain in the initial open position.

Figure 15C:
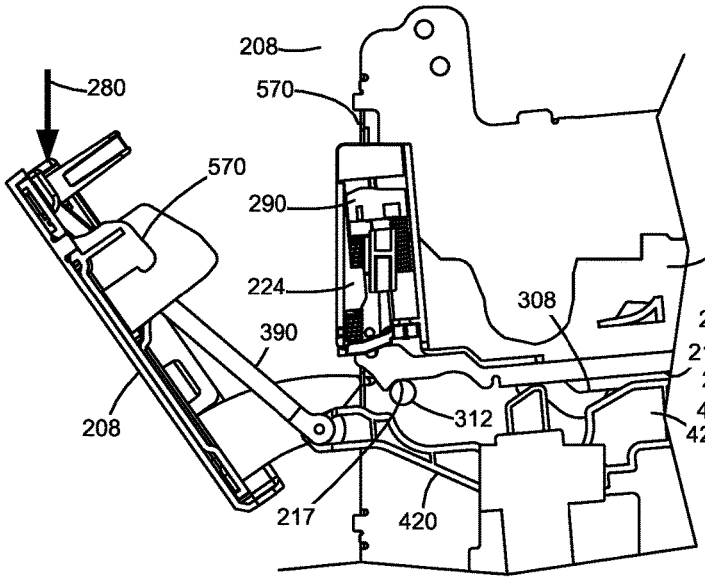
Figure 15D:
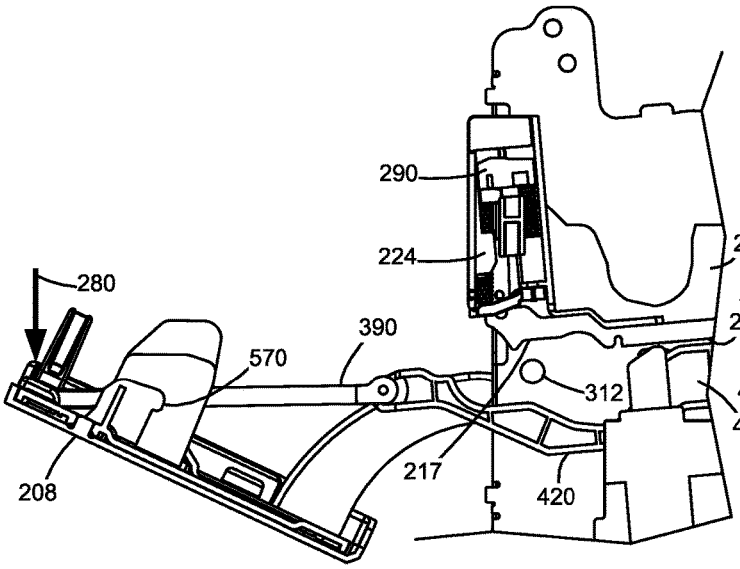
Figure 17C:
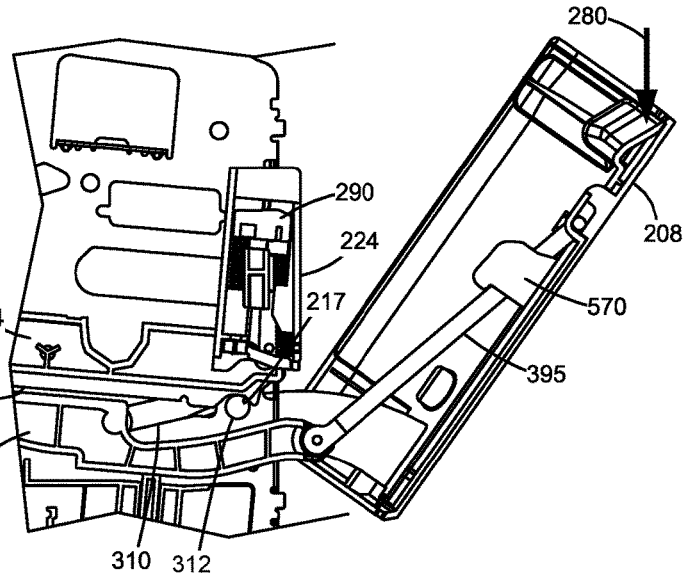

As access door 208 pivots forward (toward the user) from the initial open position upon application of user-applied downward force 280 on access door 208 as shown in FIGS. 15C and 17C, access door 208 moves left and right guide rails 420, 450 forward in a direction towards access door 208 which causes legs 514, 544 of left and right latches 510, 540 to travel up corresponding angled surfaces 429, 459 of rear ends 427, 457 of left and right guide rails 420, 450 overcoming the biasing forces of springs 516, 546, respectively. Head 512 of left latch 510 rotates away (in a clockwise direction as viewed in FIG. 16C) and disengages from latch catch 221 of basket 204 as leg 514 travels up angled surface 429 of left guide rail 420. Arm 542 of right latch 540 rotates away (in a counter-clockwise direction as viewed in FIG. 18C) and disengages from latch catch 223 of basket 204 as leg 544 travels up angled surface 459 of right guide rail 450. As left and right latches 510, 540 disengage from corresponding latch catches 221, 223 of basket 204 while both hold-down features 570 on access door 208 are disengaged from basket 204, basket 204 remains in the operational position with recessed locators 217 and V-blocks 219 of basket 204 seated on corresponding bosses 312, 314 in image forming device 22. Basket 204 also remains free from contact with left and tight guide rails 420, 450.

Figure 16C:
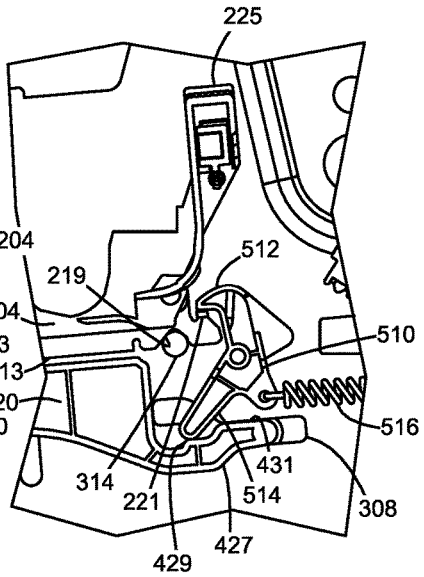
Figure 16D:
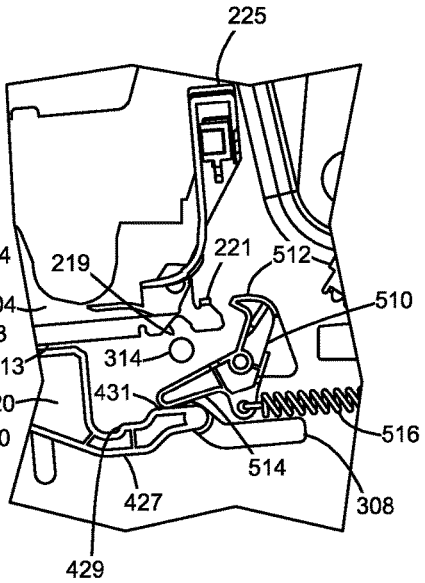
Figure 15E:
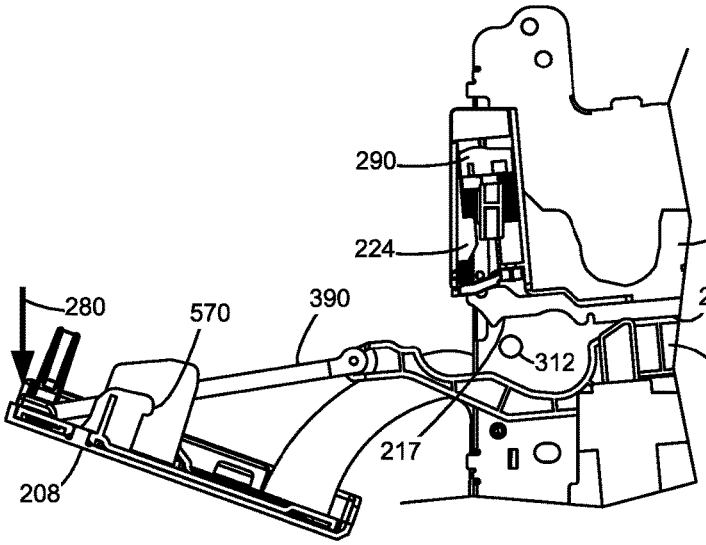
Figure 16E:
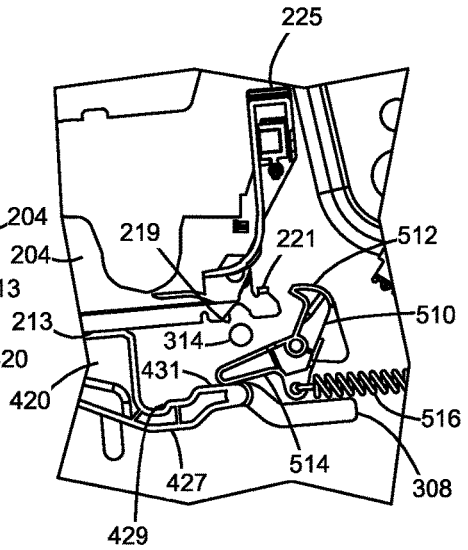
Figure 18D:
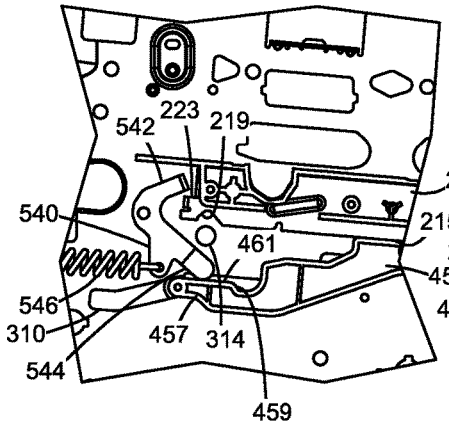
Figure 17D:
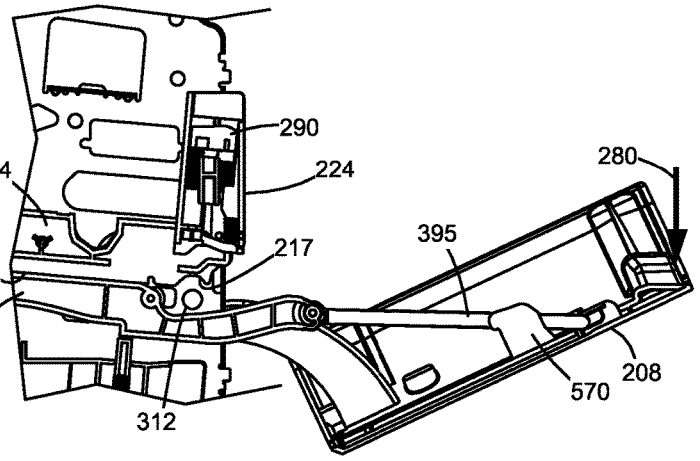
Figure 17E:
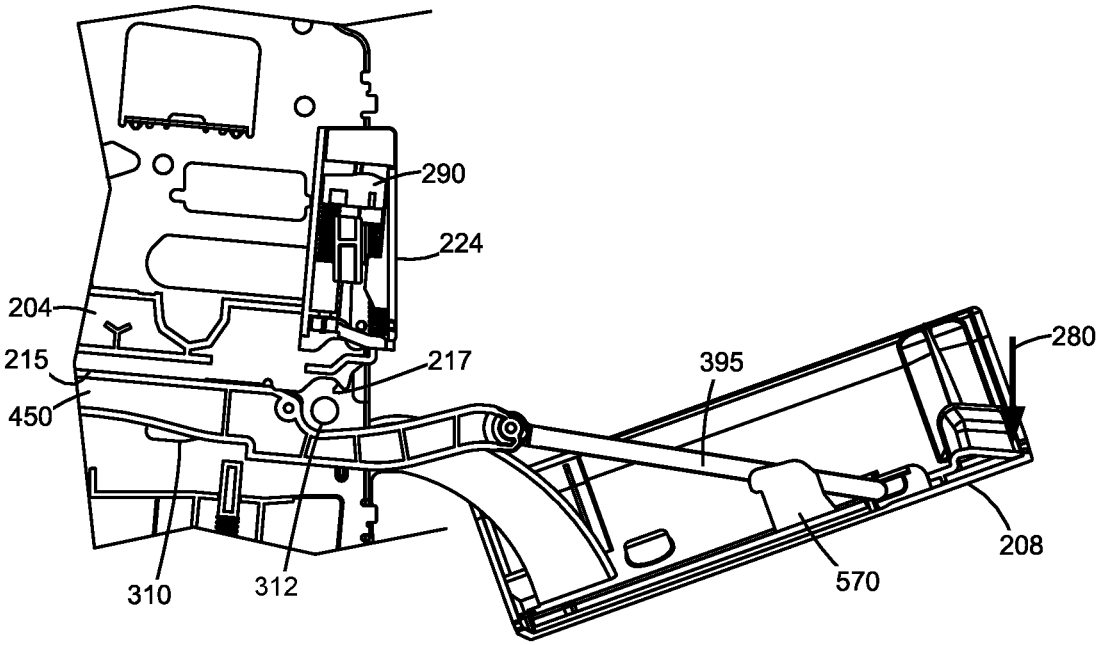
Figure 18E:
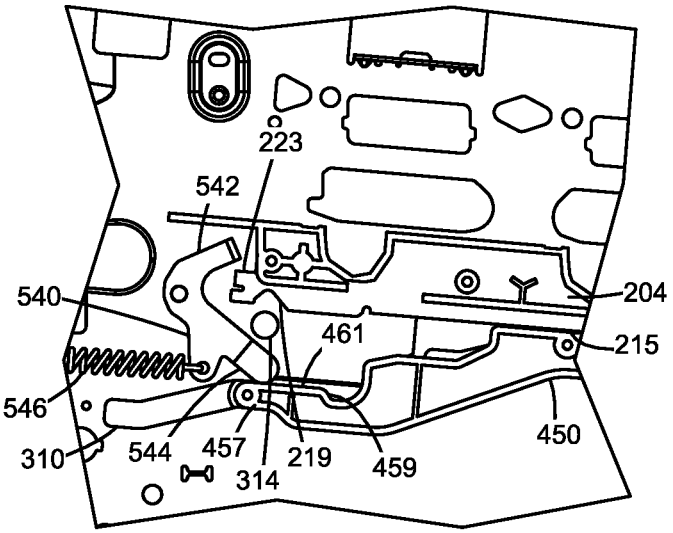

As access door 208 pivots further forward upon application of user-applied downward force 280 and pulls left and right guide rails 420, 450 further via linkages 390, 395, leg 514 of left latch 510 travels up from angled surface 429 to a corresponding upper cam surface 431 of rear end 427 of left guide rail 420 causing head 512 of left latch 510 to clear latch catch 221 of basket 204 as shown in FIG. 16D. Likewise, leg 544 of right latch 540 travels up from angled surface 459 to a corresponding upper cam surface 461 of rear end 457 of right guide rail 450 causing arm 542 of right latch 540 to clear latch catch 223 of basket 204 as shown in FIG. 18D. As access door 208 pivots further toward the final open position and pulls left and right guide rails 420, 450 via linkages 390, 395, guide pins 422, 452 of left and right guide rails 420, 450 slidably travel along corresponding ramped sections 308*b*, 310*b* of guide slots 308, 310 causing left and right guide rails 420, 450 to move up from the lowered position and contact sliding surfaces 213, 215 of sides 205, 207 of basket 204, respectively, as shown in FIGS. 15D, 16D and FIGS. 17D, 18D. Contact between basket 204 and left and right guide rails 420, 450 as left and right guide rails 420, 450 move toward the raised position lifts basket 204 upward such that recessed locators 217 and V-blocks 219 of basket 204 disengage from corresponding bosses 312, 314 in image forming device 22. Accordingly, as access door 208 approaches its final open position, the weight load of basket 204 and toner cartridges 100 is transferred from bosses 312, 314 to left and right guide rails 420, 450.

In FIGS. 15E, 16E and FIGS. 17E, 18E, access door 208 has reached its final open position and each of left and right guide rails 420, 450 is in the raised position. Guide pins 422, 452 of left and right guide rails 420, 450 rest along corresponding upper dwells 308*c*, 310*c* of guide slots 308, 310 such that left and right guide rails 420, 450 remain in the raised position slidably supporting basket 204. With access door 208 in the final open position, basket 204 may be slidably extended out of opening 201.

With reference back to FIGS. 10B and 10C, opening access door 208 exposes a handle including a spring biased release actuator 190 provided on front end wall 224 of basket 204. Spring-biased hooks 192 extend horizontally from opposite sides of front end wall 224 of basket 204 and serve as latches to secure basket 204 within image forming device 22. Spring-biased hooks 192 also secure basket 204 within image forming device 22 as basket 204 is raised and lowered by left and right guide rails 420, 450. Spring-biased hooks 192 are operatively connected to release actuator 190. To extend basket 204 out of image forming device 22, a user pulls release actuator 190 against its bias spring(s) toward access door 208 which retracts and disengages hooks 192 from corresponding catches 303 provided on front panel 302, thereby allowing basket 204 to be slid out of opening 201. In some embodiments, basket 204 may include one or more stops positioned on rear end wall 225 of basket 204 to limit the sliding movement of basket 204 out of image forming device 22.

When access door 208 is closed, the above sequence is reversed. In particular, closing access door 208 causes linkages 390, 395 to push guide rail assembly 400 into image forming device 22 causing left and right guide rails 420, 450 to move from the raised position to the lowered position as access door 208 pivots from the final open position to the initial open position, and from the initial open position to the closed position. Movement of left and right guide rails 420, 450 from the raised position toward the lowered position lowers basket 204 until basket 204 reaches its operational position where recessed locators 217 and V-blocks 219 of basket 204 contact and sit on corresponding bosses 312, 314 in image forming device 22. As left guide rail 420 approaches the lowered position, leg 514 of left latch 510 travels down angled surface 429 of rear end 427 of left guide rail 420 causing head 512 of left latch 510 to rotate toward and engage latch catch 221 of basket 204 as shown in FIG. 16B. Likewise, as right guide rail 450 approaches the lowered position, leg 544 of right latch 540 travels down angled surface 459 of right guide rail 450 causing arm 542 of right latch 540 to rotate toward and engage latch catch 223 of basket 204 as shown in FIG. 18B. When left and right guide rails 420, 450 are in the lowered position as access door 208 reaches the initial open position, left and right latches 510, 540 on left and right side panels 304, 306 hold down the rear portion of basket 204 such that contact between V-blocks 219 of basket 204 and corresponding bosses 314 in image forming device 22 is maintained to hold basket 204 in the operational position.

With left and right guide rails 420, 450 in the lowered position and basket 204 in the operational position, spring-biased pads at front end wall 224 of basket 204 are positioned to receive corresponding hold-down features 570 on inner wall 208*b* of access door 208. When the user fully closes access door 208, hold-down features 570 on access door 208 engage and push corresponding spring-biased pads 290 downward. This causes spring-biased pads 290 to push front end wall 224 of basket 204 downward such that contact between recessed locators 217 of basket 204 and corresponding bosses 312 in image forming device 22 is maintained to hold basket 204 in the operational position.

The engagement between hold-down features 570 on access door 208 and corresponding spring-biased pads 290 on front end wall 224 of basket 204, and between left and right latches 510, 540 on left and right side panels 304, 306 and corresponding latch catches 221, 223 on rear end wall 225 of basket 204 provide final positioning of toner cartridges 100 together as a single unit with basket 204 within image forming device 22. Specifically, since each toner cartridge 100 is individually positioned and latched onto basket 204 as discussed above with respect to FIGS. 8 and 9, toner cartridges 100 are held down in their respective final positions within image forming device 22 by holding down basket 204 in place without having to directly apply individual hold-down forces on each individual toner cartridge 100 using separate multiple biasing mechanisms fixedly positioned within image forming device 22 for directly engaging each individual toner cartridge 100. Locating toner cartridges 100 as a single unit to image forming device 22 helps minimize misalignment between toner cartridges 100 while rigidly holding toner cartridges 100 in place after installation in image forming device 22 to prevent the positional alignment of toner cartridges 100 from being disturbed during operation.

In one example embodiment, image forming device 22 includes features for preventing access door 208 from being closed (i.e., for access door 208 to remain in the final open position) unless basket 204 is fully inserted into image forming device 22. In particular, once basket 204 is extended out of image forming device 22, left and right guide rails 420, 450 are locked in the raised position so that access door 208 may not be closed while basket 204 is not in the fully inserted position. This prevents potential damage to toner cartridges 100 and/or prevents basket 204 from getting stuck in an incorrect position such as when a user persists in trying to close access door 208 while basket 204 is not in the fully inserted position.

Referring back to FIGS. 11-14, in the example embodiment illustrated, a rail lock assembly 600 is mounted on inner side walls 304*a*, 306*a* of left and right side panels 304, 306. Rail lock assembly 600 is positioned to lock left and right guide rails 420, 450 in the raised position when basket 204 is extended out of image forming device 22. In the embodiment illustrated, rail lock assembly 600 includes a left plunger 610 positioned on inner side wall 304*a* of left side panel 304 and a right plunger 630 positioned on inner side wall 306*a* of right side panel 306. Left and right plungers 610, 630 are positioned to selectively engage and disengage left and right guide rails 420, 450 in response to movement of basket 204 along left and right guide rails 420, 450, as discussed in greater detail below.

Figure 19A:
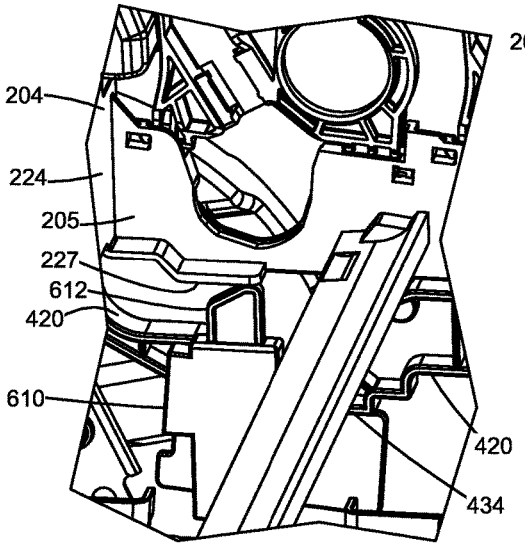
FIGS. 19A-19C are first side perspective views of the left plunger of the rail lock assembly, the left guide rail, and the basket in various positions according to one example embodiment.
Figure 20A:
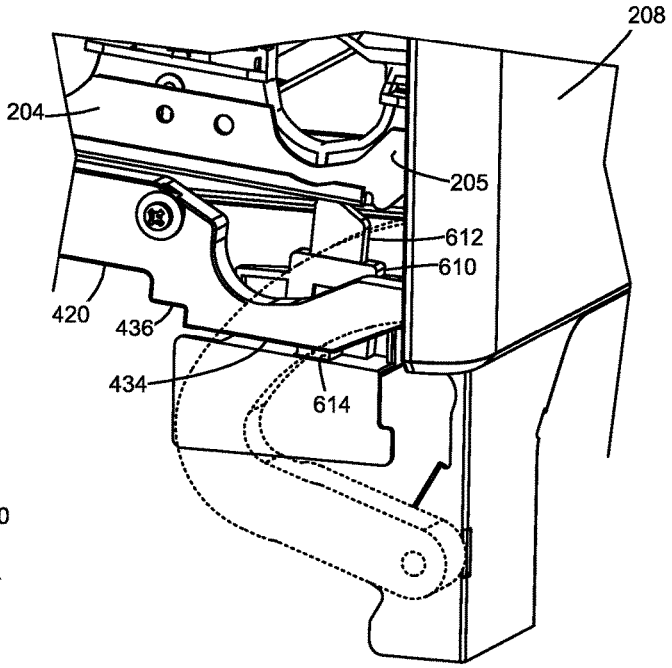
FIGS. 20A-20C are second side perspective views of the left plunger of the rail lock assembly, the left guide rail, and the basket in various positions corresponding to the positions shown in FIGS. 19A-19C, respectively, according to one example embodiment.
Figure 19B:
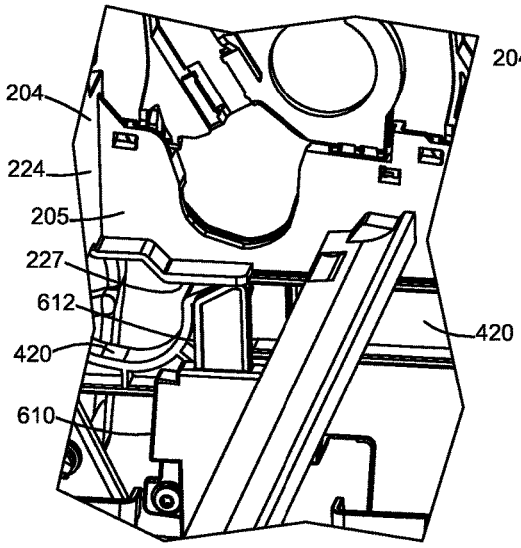
Figure 20B:
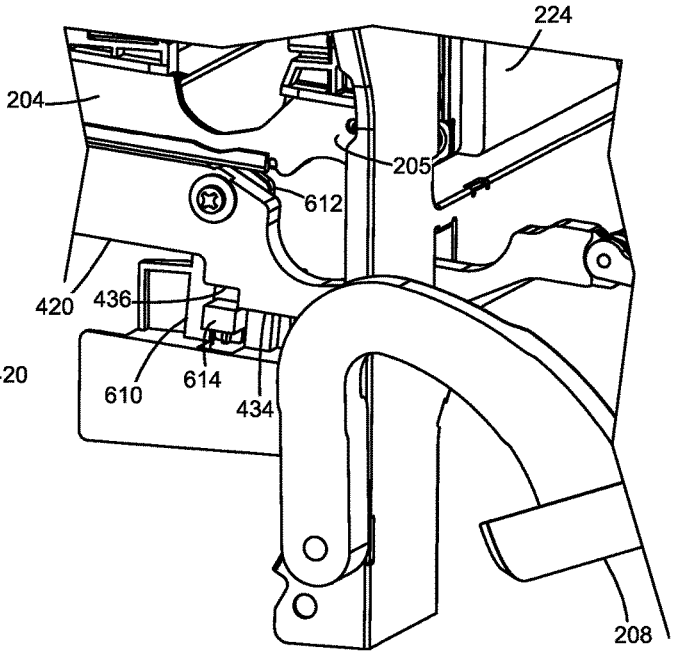
Figure 19C:
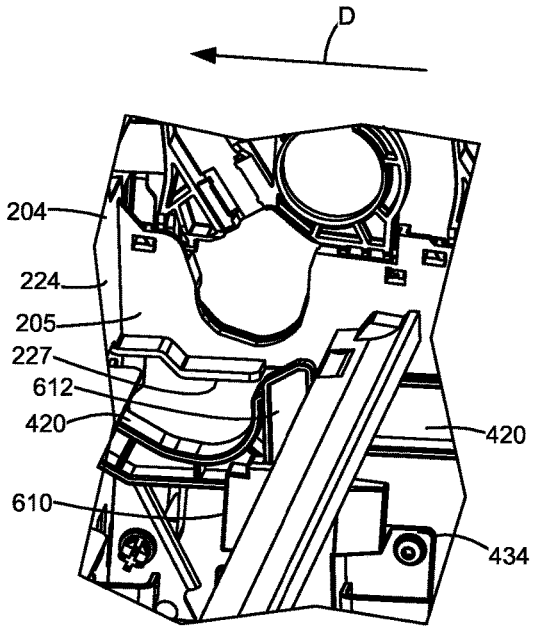
Figure 20C:
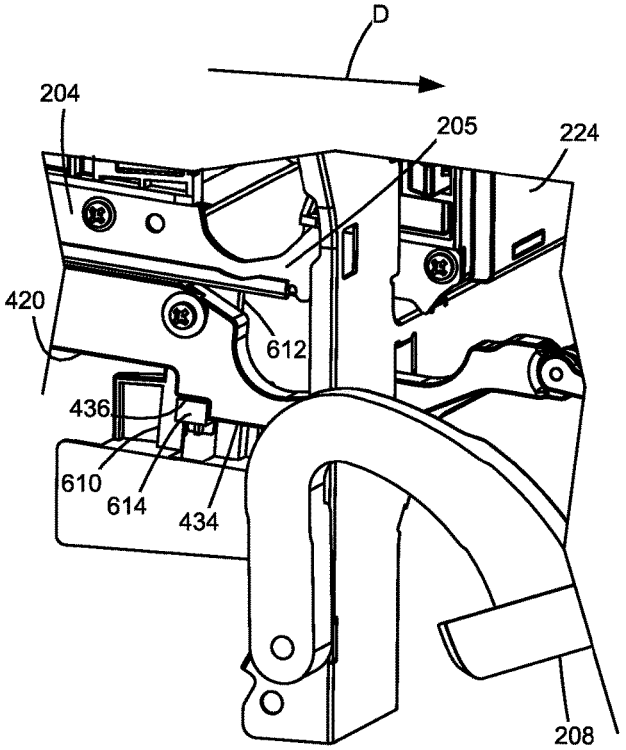
Figure 21A:
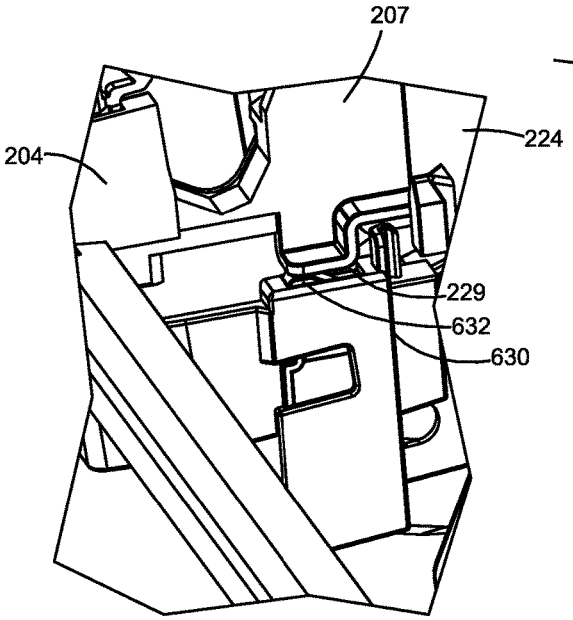
FIGS. 21A-21C are first side perspective views of the right plunger of the rail lock assembly, the right guide rail, and the basket in various positions according to one example embodiment.
Figure 22A:
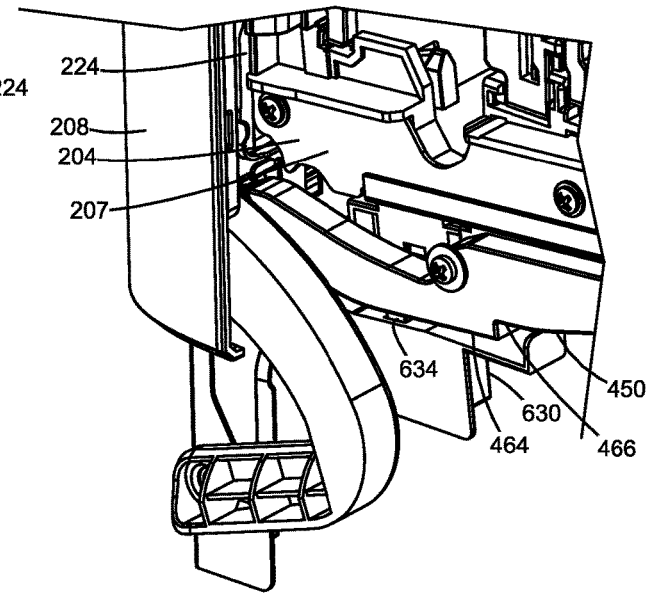
FIGS. 22A-22C are second side perspective views of the right plunger of the rail lock assembly, the right guide rail, and the basket in various positions corresponding to the positions shown in FIGS. 21A-21C, respectively, according to one example embodiment.
Figure 21B:
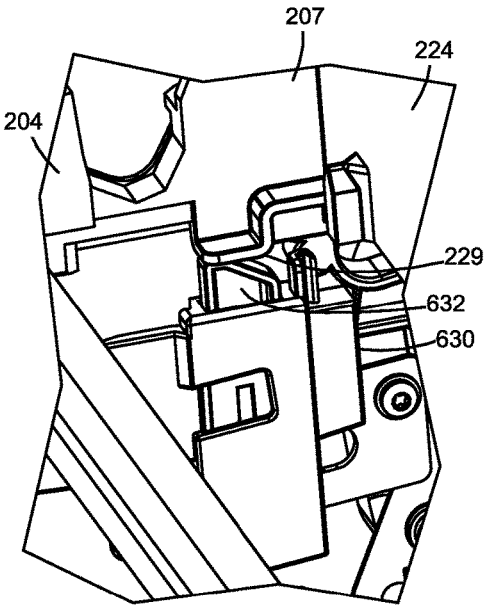
Figure 22B:
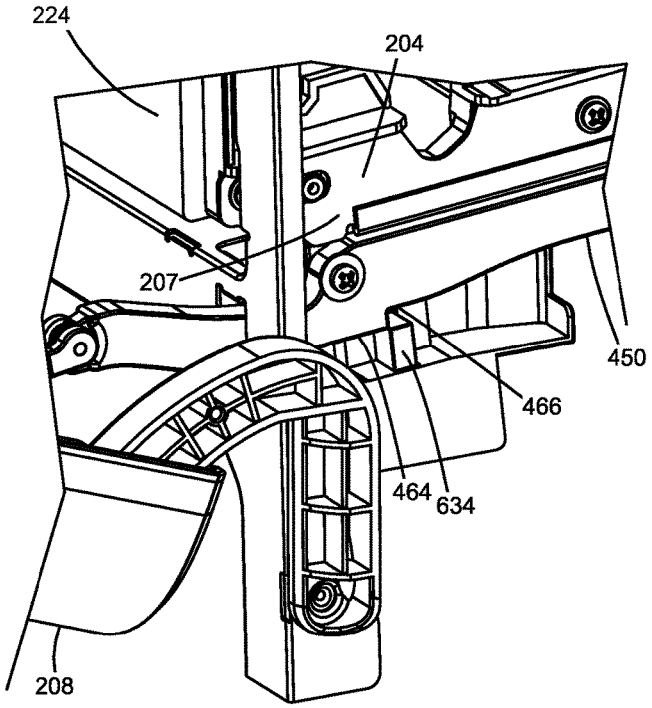
Figure 21C:
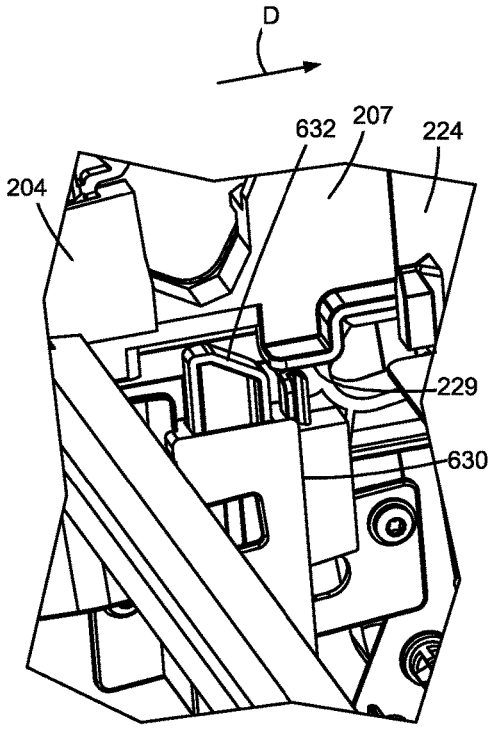
Figure 22C:
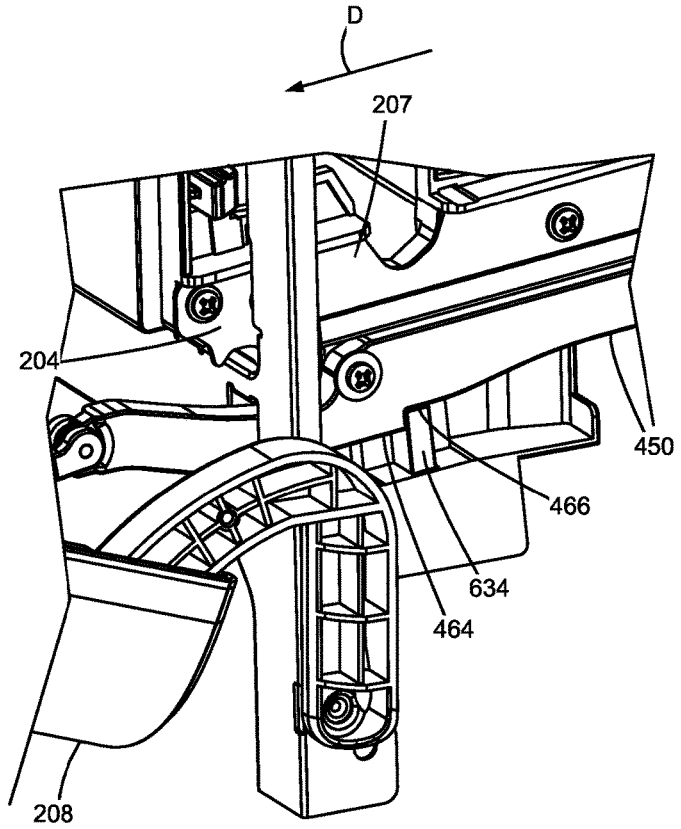

FIGS. 19A-19C are perspective views illustrating various positions of left plunger 610 including a spring-biased plunger fin 612 positioned inboard of left guide rail 420 and below side 205 of basket 204 while FIGS. 20A-20C are perspective views illustrating various positions of a left stop 614 extending from an outboard side of plunger fin 612 of left plunger 610 below left guide rail 420 corresponding to the positions shown in FIGS. 19A-19C, respectively. In one embodiment, plunger fin 612 and left stop 614 of left plunger 610 are formed as a unitary piece. FIGS. 21A-21C are perspective views illustrating various positions of right plunger 630 including a spring-biased plunger fin 632 positioned inboard of right guide rail 450 and beneath side 207 of basket 204 while FIGS. 22A-22C are perspective views illustrating various positions of a right stop 634 extending from an outboard side of plunger fin 632 of right plunger 630 below right guide rail 450 corresponding to the positions shown in FIGS. 21A-21C, respectively. In one embodiment, plunger fin 632 and right stop 634 of right plunger 630 are formed as a unitary piece. Left and right plungers 610, 630 are positioned to prevent access door 208 from being closed by restricting the movement of left and right guide rails 420, 450, respectively, unless basket 204 is fully inserted into image forming device 22.

In FIGS. 19A, 20A and FIGS. 21A, 22A, access door 208 is closed and basket 204 is in the operational position within image forming device 22. Left stop 614 of left plunger 610 is spring-loaded against a bottom surface 434 of left guide rail 420 as shown in FIG. 20A such that plunger fin 612 of left plunger 610 is not biased against a bottom engagement surface 227 provided on side 205 of basket 204 as shown in FIG. 19A. Right stop 634 of right plunger 630 is spring-loaded against a bottom surface 464 of right guide rail 450 as shown in FIG. 22A such that plunger fin 632 of right plunger 630 is not biased against a bottom engagement surface 229 provided on side 207 of basket 204 as shown in FIG. 21A, (In FIG. 22A, plunger fin 632 of right plunger 630 is obscured by basket 204). In these positions where left and right guide rails 420, 450 are in the lowered positions while basket 204 is in the operational position, substantially no load is exerted on basket 204 by left and right plungers 610, 630.

In FIGS. 19B, 20B and FIGS. 21B, 22B, access door 208 is in the final open position with each of left and right guide rails 420, 450 in the raised position raising basket 204. With basket 204 raised and fully inserted into image forming device 22, plunger fin 612 of left plunger 610 is spring-biased into contact with bottom engagement surface 227 on side 205 of basket 204 as shown in FIG. 19A thereby transferring biasing load of left plunger 610 from bottom surface 434 of left guide rail 420 to bottom engagement surface 227 on side 205 of basket 204. With left guide rail 420 in the raised position and plunger fin 612 of left plunger 610 biased against bottom engagement surface 227 on side 205 of basket 204, left stop 614 of left plunger 610 is positioned in alignment with an angled catch 436 formed on left guide rail 420 as shown in FIG. 20B. In a similar manner, plunger fin 632 of right plunger 630 is spring-biased into contact with bottom engagement surface 229 on side 207 of basket 204 as shown in FIG. 21B thereby transferring biasing load of right plunger 630 from bottom surface 464 of right guide rail 450 to bottom engagement surface 229 on side 207 of basket 204. With right guide rail 450 in the raised position and plunger fin 632 of right plunger 630 biased against bottom engagement surface 229 on side 207 of basket 204, right stop 634 of right plunger 630 is positioned in alignment with an angled catch 466 formed on right guide rail 450 as shown in FIG. 22B.

In FIGS. 19C, 20C and FIGS. 21C, 22C, basket 204 is initially slid out of image forming device 22 in direction D while access door 208 is in the final open position. As shown in FIG. 19C, plunger fin 612 of left plunger 610 is disengaged from bottom engagement surface 227 on side 205 of basket 204 as bottom engagement surface 227 of basket 204 clears plunger fin 612 of left plunger 610 when basket 204 moves in direction D. The spring force of left plunger 610 pushes plunger fin 612 upward causing left stop 614 to be positioned within angled catch 436 of left guide rail 420 as shown in FIG. 20C. In FIG. 21C, plunger fin 632 of right plunger 630 is disengaged from bottom engagement surface 229 on side 207 of basket 204 as bottom engagement surface 229 of basket 204 clears plunger fin 632 of right plunger 630 when basket 204 moves in direction D. The spring force of right plunger 630 pushes plunger fin 632 upward causing right stop 634 to be positioned within angled catch 466 of right guide rail 450 as shown in FIG. 22C. Left and right stops 614, 634 remain within corresponding angled catches 436, 466 of left and right guide rails 420, 450 while basket 204 is not in its fully inserted position within image forming device 22. Accordingly, left and right stops 614, 634 restrain movement of left and right guide rails 420, 450 in a direction opposite direction D thereby locking left and right guide rails 420, 450 in the raised position and, consequently, access door 208 in the final open position.

Left and right plungers 610, 630 prevent access door 208 from being closed unless plunger fins 612, 632 of left and right plungers 610, 630 are engaged and depressed by bottom engagement surfaces 227, 229 on sides 205, 207 of basket 204, respectively, when basket 204 is fully inserted into image forming device 22. In particular, when basket 204 moves toward its fully-inserted position (opposite direction D), bottom engagement surface 227 on side 205 of basket 204 contacts and pushes plunger fin 612 of left plunger 610 downward, as viewed in FIG. 19B, causing left stop 614 to move away from angled catch 436 of left guide rail 420, as viewed in FIG. 20B, and unlock left guide rail 420. In a similar manner, when basket 204 moves toward its fully-inserted position, bottom engagement surface 229 on side 207 of basket 204 contacts and pushes plunger fin 632 of right plunger 630 downward, as viewed in FIG. 21B, causing right stop 634 to move away from angled catch 466 of right guide rail 450, as viewed in FIG. 22B, and unlock right guide rail 450. Accordingly, once basket 204 is fully inserted into image forming device 22, left and right stops 614, 634 of left and tight plungers 610, 630 disengage left and right guide rails 420, 450 permitting movement of left and right guide rails 420, 450 such that access door 208 may be closed or opened as discussed above.

Figure 23A:
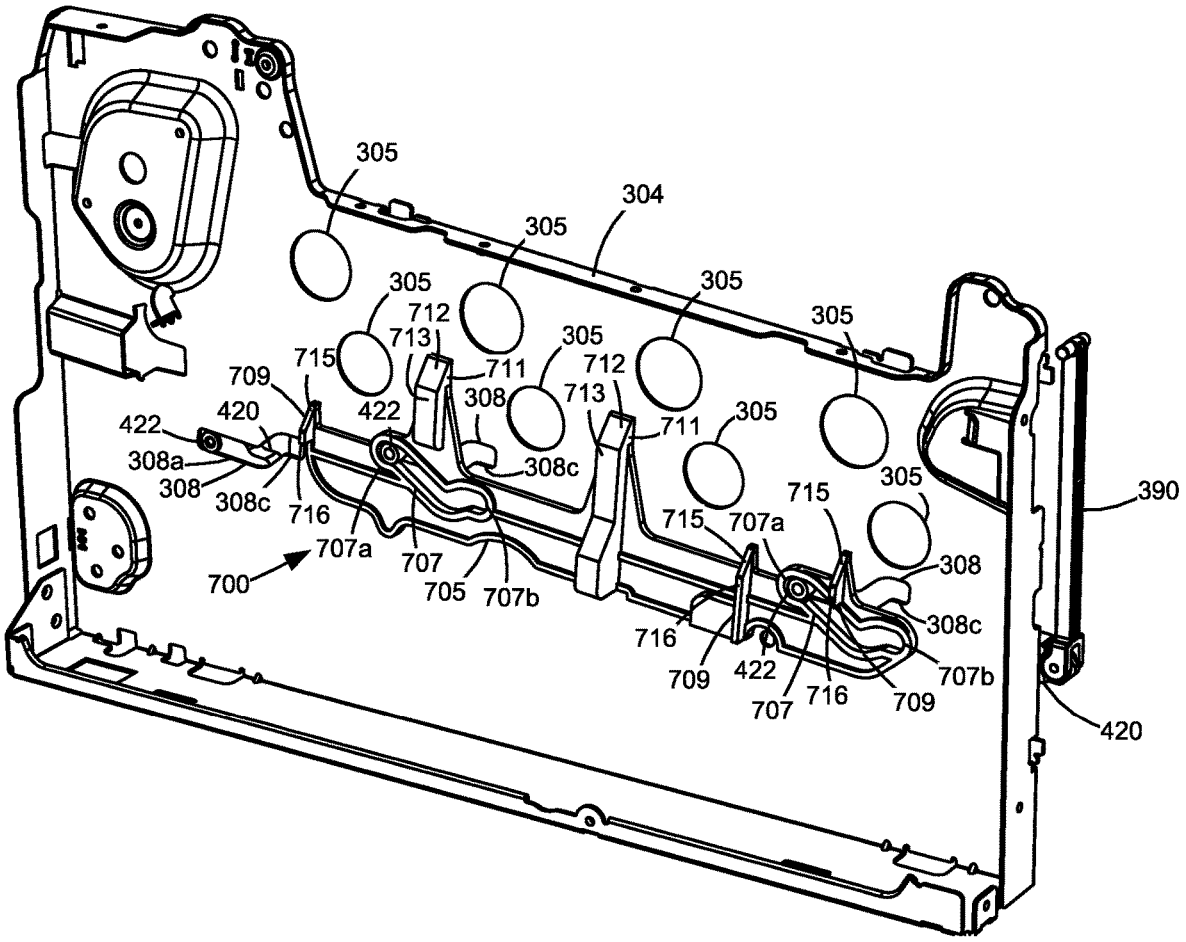
FIGS. 23A and 23B are perspective views illustrating a drive actuator in a lowered position and a raised position, respectively, operatively connected to the left guide rail according to one example embodiment.
Figure 23B:
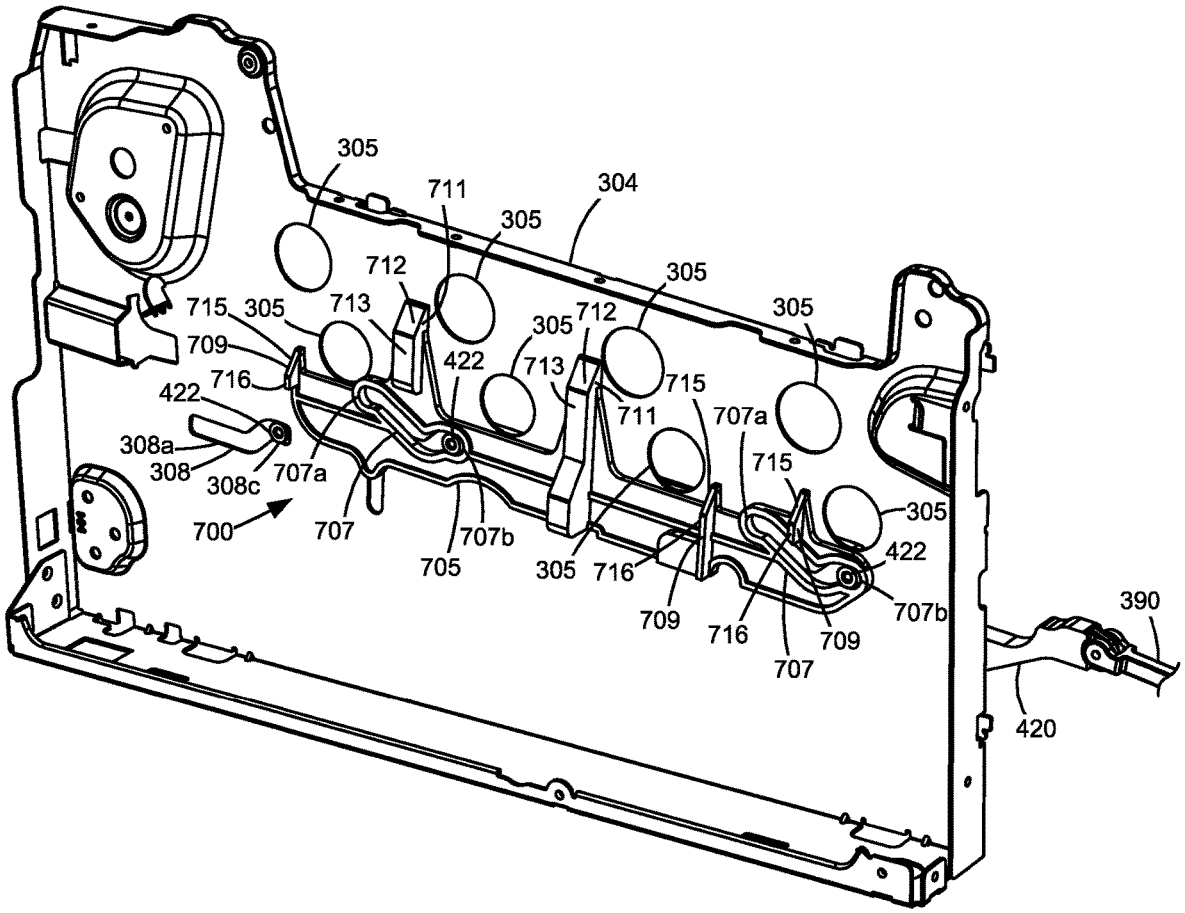

With reference to FIGS. 23A and 23B, image forming device 22 includes a drive actuation mechanism 700 positioned on left side panel 304 for actuating the drive couplers of image forming device 22 to mate with corresponding drive couplers 140, 142 of toner cartridge 100 when basket 204 is fully inserted into image forming device 22 and access door 208 is closed. In the embodiment illustrated, drive actuation mechanism 700 includes a drive actuator 705 positioned on left side panel 304 to receive an actuation force from the opening and closing movement of access door 208. In one example embodiment, left guide rail 420 and drive actuator 705 are operatively connected to each other such that movement of left guide rail 420 between the lowered position and the raised position moves drive actuator 705 between a corresponding lowered position shown in FIG. 23A and a corresponding raised position shown in FIG. 23B, respectively.

In the embodiment illustrated, drive actuator 705 includes angled slots 707 for receiving corresponding slide pins 422 of left guide rail 420 extending through guide slots 308 of left side panel 304 such that movement of left guide rail 420 between the lowered position and the raised position causes slide pins 422 of left guide rail 420 to move drive actuator 705 between its corresponding lowered position and corresponding raised position, respectively, as slide pins 422 of left guide rail 420 travel along corresponding guide slots 308 of left side panel 304 while slide pins 422 of left guide rail 420 are in contact with drive actuator 705 via angled slots 707 of drive actuator 705. When drive actuator 705 is in its corresponding lowered position due to left, guide rail 420 being in the lowered position (i.e., access door 208 is closed) as shown in FIG. 23A, slide pins 422 of left guide rail 420 are positioned at corresponding first ends 707*a* of angled slots 707 of drive actuator 705 while slide pins 422 of left guide rail 420 rest on corresponding lower dwells 308*a* of guide slots 308 of left side panel 304. When drive actuator 705 is in its corresponding raised position due to left guide rail 420 being in the raised position (i.e., access door 208 is opened) as shown in FIG. 23B, slide pins 422 of left guide rail 420 are positioned at corresponding second ends 707*b* of angled slots 707 of drive actuator 705 while slide pins 422 of left guide rail 420 rest on corresponding upper dwells 308*c* of guide slots 308 of left side panel 304. Fasteners 423 (FIG. 13) attached to corresponding slide pins 422 retain drive actuator 705 against left side panel 304. The operation of drive actuation mechanism 700 is discussed in greater detail below.

Figure 24:
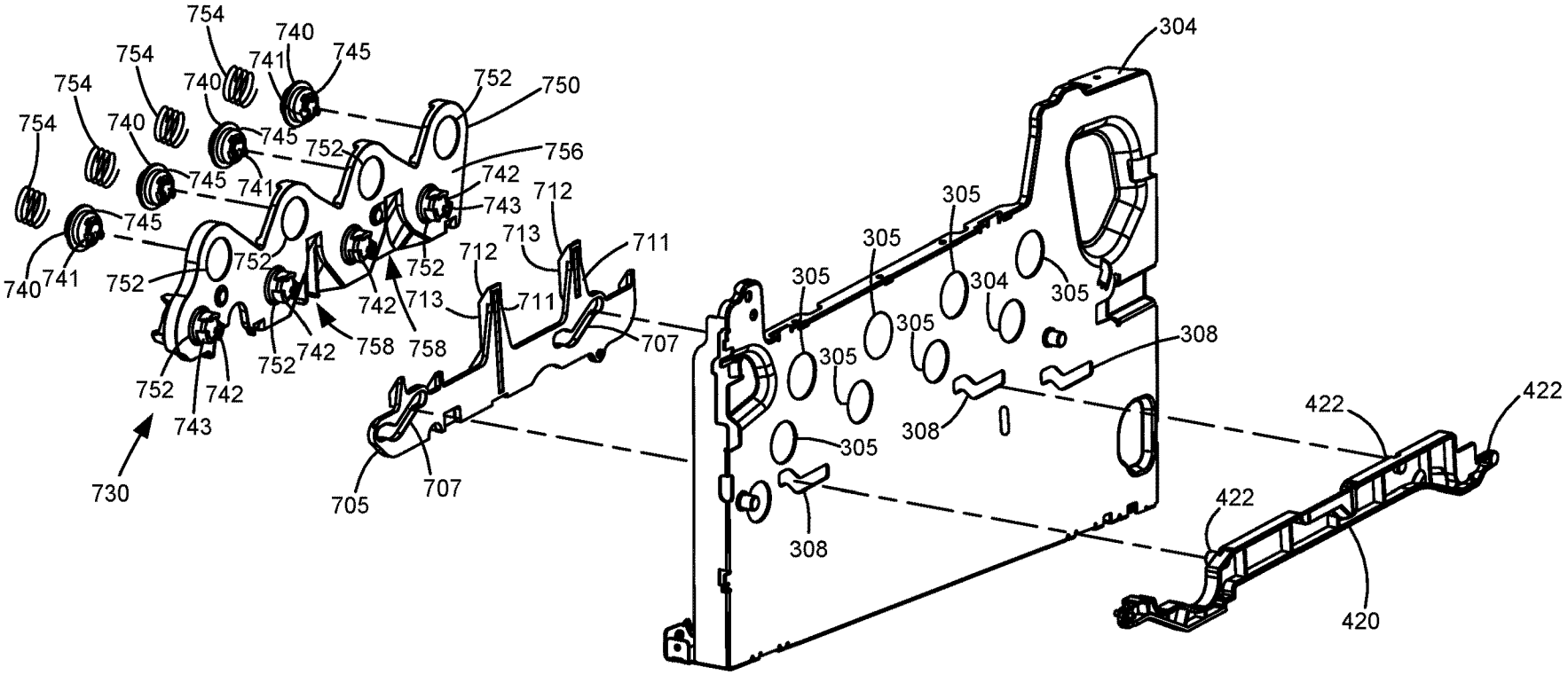
FIG. 24 is an exploded view showing the drive actuator of FIGS. 23A and 23B and a drive system of the image forming device according to one example embodiment.

FIG. 24 is an exploded view showing left guide rail 420, left side panel 304, drive actuator 705, and a drive system 730 of image forming device 22 according to one example embodiment. In the example embodiment illustrated, drive system 730 includes a plurality of drive couplers 740, 742 positioned to engage and provide rotational force from one or more electric motors in image forming device 22 to corresponding drive couplers 140, 142 of toner cartridges 100. In one embodiment, a common motor may be used to drive couplers 740, 742 of drive system 730 such as by using a gear train connecting drive couplers 740, 742. In other embodiments, separate motors may be used to drive couplers 740 and couplers 742.

Each drive coupler 740, 742 of drive system 730 includes drive lugs 741, 743 extending through a corresponding aperture 752 formed on a frame collar 750. In the embodiment illustrated in FIG. 24, drive couplers 740 are exploded from corresponding apertures 752 of frame collar 750 while drive lugs 743 of drive couplers 742 are shown extending through corresponding apertures 752. In one embodiment, each aperture 752 is sized to allow drive lugs 741, 743 of a corresponding drive coupler 740, 742 to pass through but obstruct an outer ring 745 extending radially from each drive coupler 740, 742. Each of drive couplers 740, 742 is axially biased by a corresponding biasing member 754, such as a compression spring, in a direction towards left side panel 304. Due to the biasing forces provided by biasing members 754 on corresponding drive couplers 740, 742, respective outer rings 745 of drive couplers 740, 742 are axially biased against frame collar 750 such that frame collar 750, in turn, is axially biased by each of drive couplers 740, 742 axially toward left side panel 304 while drive lugs 741, 743 of drive couplers 740, 742 extend through corresponding apertures 752 of frame collar 750. Each drive coupler 740, 742 of drive system 730 is positioned to pass through corresponding openings 305 formed on left side panel 304 and align with corresponding drive couplers 140, 142 of toner cartridges 100.

Drive actuator 705 is slidably mounted on left side panel 304 to actuate frame collar 750 and, in turn, drive couplers 740, 742, in response to movement of left guide rail 420 between the lowered position and the raised position as access door 208 is closed and opened. In the embodiment illustrated, drive actuator 705 includes a pair of cam arms 711 and engagement ribs 709 operative to selectively engage frame collar 750 of drive system 730 to move drive couplers 740, 742 of drive system 700 relative to corresponding drive couplers 140, 142 of toner cartridges 100. Each cam arm 711 of drive actuator 705 is sized and shaped to fit within a corresponding channel 758 formed on frame collar 750 without contacting frame collar 750 when drive actuator 705 is in its corresponding lowered position (i.e., when access door is closed), and to contact frame collar 750 when drive actuator 705 moves toward its corresponding raised position (i.e., when access door is opened). Each channel 758 extends in the vertical dimension such that each of cam arms 711 is translatable up and down along corresponding channels 758 as drive actuator 705 moves between its corresponding raised and lowered positions. Engagement ribs 709 are sized and shaped to be free from contact with frame collar 750 when drive actuator 705 is in its corresponding lowered position (when access door is closed), and to contact frame collar 750 when drive actuator 705 moves toward its corresponding raised position (when access door is opened).

In the embodiment illustrated, the profile of each cam arm 711 includes an angled engagement surface 712 and a side engagement surface 713 (see also FIGS. 23A and 23B) that are configured to contact frame collar 750 for moving frame collar 750 and, in turn, drive couplers 740, 742 of drive system 730, relative to corresponding drive couplers 140, 142 of toner cartridge 100 when drive actuator 705 translates along channels 758. In the embodiment illustrated in FIGS. 23A and 23B, each engagement rib 709 includes a tapered edge 715 and a side edge 716 for contacting and moving frame collar 750 in the same manner as cam arms 711. The operation of drive actuator 705 and drive system 730 is discussed in greater detail below.

Figure 25A:
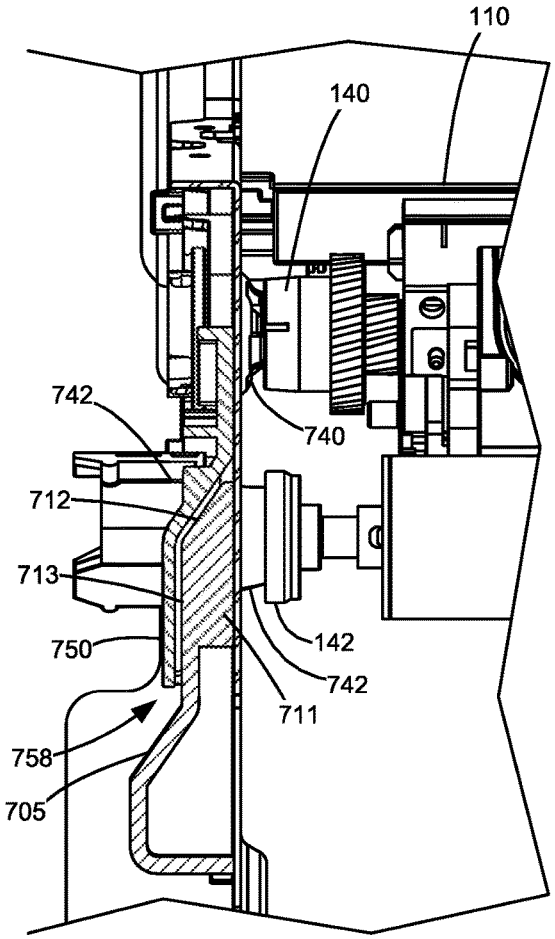
FIG. 25A is a cross-sectional view showing the drive actuator in the lowered position and drive couplers of the drive system of FIG. 24 engaged with corresponding drive couplers of the toner cartridge according to one example embodiment.
Figure 25B:
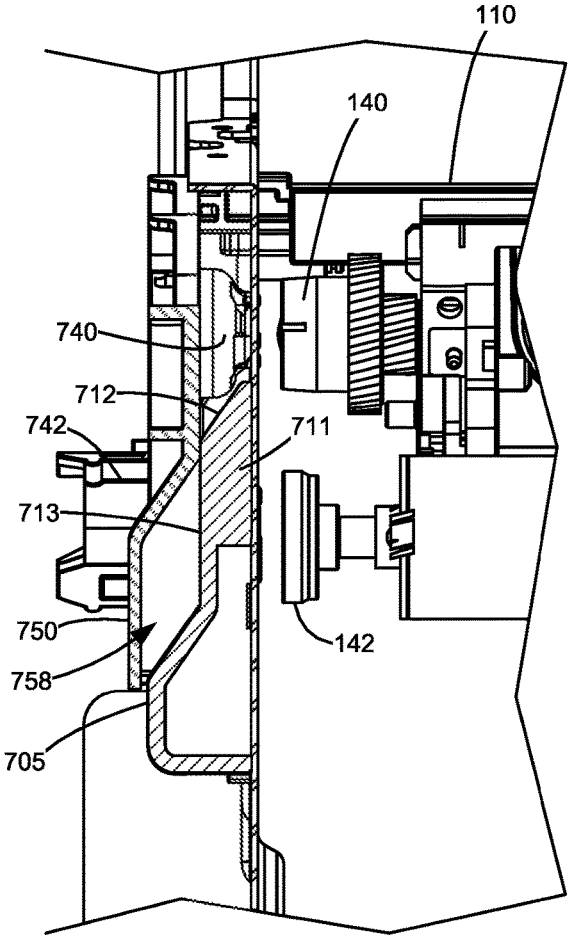
FIG. 25B is a cross-sectional view showing the drive actuator in the raised position and the drive couplers of the drive system of FIG. 24 disengaged from corresponding drive couplers of the toner cartridge according to one example embodiment.

FIGS. 25A and 25B are cross-sectional views showing drive actuator 705 and frame collar 750 of drive system 730. In the embodiment illustrated, frame collar 750 is axially movable between an extended position shown in FIG. 25A and a retracted position shown in FIG. 25B. In the extended position, frame collar 750 is biased (by drive couplers 740, 742 as discussed above) to a position where drive lugs 741, 743 of drive couplers 740, 742 of drive system 730 extend through corresponding openings 305 of left side panel 304 and engage corresponding drive couplers 140, 142 of toner cartridge 100. In one embodiment, the extended position of frame collar 750 is defined by left side panel 304 which limits the range of axial travel of frame collar 750. In this embodiment, frame collar 750 is biased against left side panel 304 as drive couplers 740, 742 axially bias frame collar 750 in a direction toward left side panel 304. Contact between frame collar 750 and left side panel 304 define the extended position of frame collar 750 shown in FIG. 25A where drive couplers 740, 742 of drive system 700 engage with corresponding drive couplers 140, 142 of toner cartridge 100. In the retracted position, frame collar 750 is retracted away from left side panel 304 against the biasing forces of biasing members 754 such that drive couplers 740, 742 of drive system 730 are retracted away and disengaged from corresponding drive couplers 140, 142 of toner cartridges 100.

In the embodiment illustrated in FIG. 25A where frame collar 750 is in the extended position, frame collar 750 is free from contact with drive actuator 705 while drive actuator 705 is in its corresponding lowered position due to left guide rail 420 being in the lowered position, such as when access door 208 is closed or is in the initial open position. When drive actuator 705 moves vertically upward as left guide rail 420 moves from the lowered position to the raised position, angled engagement surfaces 712 of cam arms 711 and tapered edges 715 of engagement ribs 709 of drive actuator 705 contact frame collar 750. Vertical motion of drive actuator 705 along channels 758 translates into axial motion of frame collar 750 while frame collar 750 is in contact with angled engagement surfaces 712 of cam arms 711 and tapered edges 715 of engagement ribs 709 of drive actuator 705. In particular, when drive actuator 705 moves towards its corresponding raised position while frame collar 750 is in contact with angled engagement surfaces 712 of cam arms 711 and tapered edges 715 of engagement ribs 709 of drive actuator 705, angled engagement surfaces 712 of cam arms 711 and tapered edges 715 of engagement ribs 709 exert an actuation force on frame collar 750 against the biasing forces of biasing members 754 of drive couplers 740, 742, causing frame collar 750 to move axially in a direction away from left side panel 304 causing drive couplers 740, 742 of drive system 730 to disengage corresponding drive couplers 140, 142 of toner cartridges 100. Frame collar 750 continues to travel along angled engagement surfaces 712 of cam arms 711 and tapered edges 715 of engagement ribs 709 away from left side panel 304 as drive actuator 705 moves further upward until frame collar 750 reaches the retracted position in which contact between frame collar 750 and drive actuator 705 reaches side engagement surfaces 713 of cam arms 711 and side edges 716 of engagement ribs 709 when drive actuator 705 reaches its corresponding raised position as shown in FIG. 25B (i.e., access door 208 has reached the final open position). It is noted that because both cam arms 711 and engagement ribs 709 of drive actuator 705 operate in the same manner in terms of moving frame collar 750, and for reasons of simplicity, only cam arms 711 are illustrated in FIGS. 25A and 25B.

When access door 208 is closed, the above sequence is reversed. In particular, closing access door 208 moves drive actuator 705 from its corresponding raised position to its corresponding lowered position which causes frame collar 750 to move from the retracted position to the extended position as shown in FIGS. 25B and 25A, respectively. In the embodiment illustrated, from the retracted position, frame collar 705 slides along side engagement surface 713 of cam arms 711 and side edges 716 of engagement ribs 709 of drive actuator 705 as biasing forces of biasing members 754 push frame collar 750 against drive actuator 705 while drive actuator 705 moves from its corresponding raised position to its corresponding lowered position. As drive actuator 705 moves further toward its corresponding lowered position, frame collar 750 slides along angled engagement surface 712 of cam arms 711 and tapered edges 715 of engagement ribs 709 of drive actuator 705 causing frame collar 750 to move towards left side panel 304 as biasing forces of biasing members 754 continue to push frame collar 750 against drive actuator 705 until frame collar 750 reaches the extended position in which frame collar 750 contacts left side panel 304 and becomes free from contact with drive actuator 705 as drive actuator 705 returns to its corresponding lowered position.

Further, as frame collar 750 reaches the extended position and drive couplers 740, 742 of drive system 730 engage corresponding drive couplers 140, 142 of toner cartridges 100, the biasing forces of biasing members 754 acting on drive couplers 740, 742 axially biases each toner cartridge 100 in a direction towards right side panel 306 such that basket 204, in turn, is axially biased by each of drive couplers 740, 742 against right side panel 306. In one embodiment, side 207 of basket 204 includes contact points or surfaces 231, 233 (see FIG. 7) that are biased into contact against corresponding locating surfaces on right side panel 306 to define a horizontal position of basket 204 along the widthwise dimension of drawer 202 perpendicular to sliding direction 203 of drawer 202. In this manner, biasing forces applied by drive couplers 740, 742 of drive system 730 to toner cartridges 100 aid in preventing basket 204 and toner cartridges 100 from shifting horizontally along the widthwise dimension of drawer 202 during operation of toner cartridge 100 in image forming device 22.

Although the example embodiment discussed above includes a single replaceable unit in the form of toner cartridge 100 for each toner color, it will be appreciated that the replaceable unit(s) of the image forming device may employ any suitable configuration as desired. For example, in one embodiment, the main toner supply for the image forming device is provided in a first replaceable unit and the developer unit and photoconductor unit are provided in a second replaceable unit. In another embodiment, the main toner supply for the image forming device and the developer unit are provided in a first replaceable unit and the photoconductor unit is provided in a second replaceable unit. Other configurations may be used as desired.

Further, it will be appreciated that the architecture and shape of toner cartridge 100 illustrated in FIGS. 2, 4, 5, 8, and 9 is merely intended to serve as an example. Those skilled in the art understand that toner cartridges, and other toner containers, may take many different shapes and configurations.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A system for an electrophotographic image forming device, comprising:

a plurality of toner cartridges;

a basket insertable into and extendable out of the image forming device, the basket includes a plurality of positioning slots each configured to receive a corresponding toner cartridge of the plurality of toner cartridges, the basket includes a cartridge latching assembly configured to apply a hold-down force on each of the plurality of toner cartridges to rigidly hold each of the plurality of toner cartridges against corresponding datums of the basket; and a basket latching assembly in the image forming device configured to apply a hold-down force on the basket when the basket is inserted into the image forming device to rigidly hold the basket against corresponding datums of the image forming device for positioning the plurality of toner cartridges in respective operational positions within the image forming device with only the cartridge latching assembly of the basket directly applying hold-down forces on the plurality of toner cartridges.

2. The system of claim 1, wherein the basket latching assembly includes a first latch positioned at a first side of the image forming device and a second latch positioned at a second side of the image forming device opposite the first side, each of the first and second latches is movable between a latched position to apply a corresponding hold-down force on the basket when the basket is inserted into the image forming device and an unlatched position to release the basket permitting the basket to extend out of the image forming device.

3. The system of claim 2, wherein each of the first and second latches is biased towards the latched position.

4. The system of claim 2, wherein the first and second latches are movable together between the latched positions and the unlatched positions.

5. The system of claim 2, wherein each of the first and second latches is pivotable between the latched position and the unlatched position.

6. The system of claim 1, further comprising a guide rail assembly positioned within the image forming device, the guide rail assembly is movable relative to the image forming device between a raised position and a lowered position and is positioned to raise and lower the basket when the guide rail assembly moves between the raised position and the lowered position with the basket inserted into the image forming device, the basket is slidable along the guide rail assembly into and out of the image forming device when the guide rail assembly is in the raised position, the basket latching assembly holds the basket against the corresponding datums of the image forming device when the guide rail assembly is in the lowered position.

7. The system of claim 6, wherein the basket is free from contact with the guide rail assembly when the guide rail assembly is in the lowered position.

8. The system of claim 1, further comprising an access door movable between a closed position covering an opening of the image forming device and an open position exposing the opening of the image forming device, the basket latching assembly includes a projection extending from an inner portion of the access door such that the projection applies a hold-down force on the basket when the access door is in the closed position.

9. The system of claim 8, wherein the basket includes a spring-biased pad positioned at a front portion of the basket to contact the projection of the access door and receive the hold-down force from the projection of the access door when the basket is inserted into the image forming device and the access door is in the closed position.

10. A system for an electrophotographic image forming device, comprising:

a basket insertable into and extendable out of the image forming device, the basket includes a plurality of positioning slots each configured to hold a corresponding toner cartridge of a plurality of toner cartridges, the basket includes a cartridge latching assembly configured to apply a hold-down force on each of the plurality of toner cartridges to hold each of the plurality of toner cartridges against corresponding datums of the basket;

a guide rail assembly positioned within the image forming device, the guide rail assembly is movable relative to the image forming device between a raised position and a lowered position and is positioned to raise and lower the basket when the guide rail assembly moves between the raised position and the lowered position with the basket inserted into the image forming device, the basket is slidable along the guide rail assembly into and out of the image forming device when the guide rail assembly is in the raised position, the basket is in an operational position within the image forming device when the guide rail assembly is in the lowered position; and a basket latching assembly in the image forming device configured to hold the basket in the operational position of the basket when the guide rail assembly is in the lowered position.

11. The system of claim 10, wherein the basket latching assembly includes a first latch positioned at a first side of the image forming device and a second latch positioned at a second side of the image forming device opposite the first side, each of the first and second latches is movable between a latched position to apply a corresponding hold-down force on the basket when the basket is inserted into the image forming device and an unlatched position to release the basket permitting the basket to extend out of the image forming device.

12. The system of claim 10, wherein the basket is free from contact with the guide rail assembly when the guide rail assembly is in the lowered position.

13. The system of claim 10, further comprising an access door movable between a closed position covering an opening of the image forming device and an open position exposing the opening of the image forming device, the basket latching assembly includes a projection extending from an inner portion of the access door such that the projection applies a hold-down force on the basket when the access door is in the closed position.

14. A system for an electrophotographic image forming device, comprising:

an access door movable between a closed position covering an opening of the image forming device and an open position exposing the opening of the image forming device;

a basket insertable into and extendable out of the opening when the access door is in the open position, the basket includes a plurality of positioning slots each configured to hold a corresponding toner cartridge of a plurality of toner cartridges, the basket includes a cartridge latching assembly configured to apply a hold-down force on each of the plurality of toner cartridges to hold each of the plurality of toner cartridges against corresponding datums of the basket; and a basket latching assembly in the image forming device movable between a latching position and an unlatching position, the basket latching assembly is operatively connected to the access door such that the basket latching assembly moves from the latching position to the unlatching position when the access door moves from the closed position to the open position and the basket latching assembly moves from the unlatching position to the latching position when the access door moves from the open position to the closed position, the basket latching assembly is configured to hold the basket against corresponding datums of the image forming device when the basket latching assembly is in the latching position, the basket latching assembly is configured to release the basket permitting the basket to extend out of the opening when the basket latching assembly is in the unlatching position.

15. The system of claim 14, further comprising a guide rail assembly positioned within the image forming device, the guide rail assembly is movable relative to the image forming device between a raised position and a lowered position and is positioned to raise and lower the basket when the guide rail assembly moves between the raised position and the lowered position with the basket inserted into the image forming device, the basket is slidable along the guide rail assembly into and out of the image forming device when the guide rail assembly is in the raised position, the basket latching assembly holds the basket against the corresponding datums of the image forming device when the guide rail assembly is in the lowered position.

16. The system of claim 15, wherein the guide rail assembly is operatively connected to the access door such that the guide rail assembly moves from the lowered position to the raised position when the access door moves from the closed position to the open position and the guide rail assembly moves from the raised position to the lowered position when the access door moves from the open position to the closed position.

17. The system of claim 15, wherein basket latching assembly is operatively connected to the guide rail assembly such that the basket latching assembly moves from the latching position to the unlatching position when the guide rail assembly moves from the lowered position to the raised position and the basket latching assembly moves from the unlatching position to the latching position when the guide rail assembly moves from the raised position to the lowered position.

18. The system of claim 17, wherein the basket latching assembly is free from contact with the guide rail assembly when the basket latching assembly is in the latching position and the guide rail assembly is in the lowered position.

19. The system of claim 17, wherein the basket latching assembly biases the guide rail assembly towards the lowered position when the basket latching assembly is in the unlatching position and the guide rail assembly is in the raised position.

* * * * *